US011149457B2

(12) United States Patent
Baldoni et al.

(10) Patent No.: US 11,149,457 B2
(45) **Date of Patent: *Oct. 19, 2021**

(54) MOLDING SYSTEM FOR SWIMMING POOL COPINGS

(71) Applicant: Concrete Countertop Solutions, Inc., Clarks Summit, PA (US)

(72) Inventors: Dario Joseph Baldoni, Boston, MA (US); Edwin Joseph Baldoni, Union Dale, PA (US)

(73) Assignee: Concrete Countertop Solutions, Inc., Clarks Summit, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/984,851

(22) Filed: Aug. 4, 2020

(65) Prior Publication Data

US 2020/0362581 A1 Nov. 19, 2020

Related U.S. Application Data

(63) Continuation of application No. 15/580,844, filed as application No. PCT/US2016/036316 on Jun. 8, 2016, now Pat. No. 10,794,074.

(Continued)

(51) Int. Cl.
*E04H 4/14* (2006.01)
*B25B 27/02* (2006.01)

(52) U.S. Cl.
CPC ..... *E04H 4/141* (2013.01); *E04H 4/142* (2013.01); *B25B 27/02* (2013.01); *E04H 2004/147* (2013.01)

(58) Field of Classification Search
CPC ..... E04H 4/0075; E04H 4/0081; E04H 4/141; E04H 4/142; E04H 2004/147
See application file for complete search history.

(56) References Cited

U.S. PATENT DOCUMENTS 3,512,326 A * 5/1970 Greene ..... E04D 3/405 52/716.2
4,335,474 A * 6/1982 Bailey ..... E04H 4/142 4/506

(Continued)

OTHER PUBLICATIONS

International Search Report, dated Oct. 7, 2016, for International Application No. PCT/US2016/036316.

(Continued)

*Primary Examiner* — Michael Safavi
(74) *Attorney, Agent, or Firm* — Morgan, Lewis & Bockius LLP

(57) ABSTRACT

A molding system for a swimming pool coping having a track for receiving a pool cover includes an adaptor configured to be positioned at least partially within the track, the adaptor having a front wall, a lower portion extending from the front wall, an upper portion extending from the front wall, and an upper flange extending from the upper portion. The molding system may further include a spacer configured to be at least partially positioned between and abut against the lower portion and the upper portion of the adaptor. A tool for removing a molding system includes a blade having a top surface, a bottom surface, and an edge, a base connected to the blade opposite the edge having an abutment arranged substantially coplanar with the bottom surface, and a handle connected to the blade disposed along an axis that is obliquely angled with respect to the bottom surface.

27 Claims, 19 Drawing Sheets

Related U.S. Application Data

(60) Provisional application No. 62/174,210, filed on Jun. 11, 2015.

(56) References Cited

U.S. PATENT DOCUMENTS 4,395,014 A * 7/1983 Deason ..... E04H 4/141 249/10
4,457,119 A 7/1984 Dahowski
4,967,424 A * 11/1990 Stegmeier ..... E04H 4/142 4/496
6,324,706 B1 * 12/2001 Epple ..... E04H 4/101 4/502
6,418,572 B1 7/2002 Epple et al.
6,477,722 B2 * 11/2002 Busatta ..... E04H 4/1227 4/507
9,476,215 B2 10/2016 Baldoni et al.
2003/0084619 A1 * 5/2003 Smith ..... E04H 4/101 52/102
2004/0123380 A1 * 7/2004 Shebek ..... E04H 4/141 4/502
2005/0091738 A1 * 5/2005 Smith ..... E04H 4/142 4/506
2011/0061158 A1 * 3/2011 Smith ..... E04H 4/101 4/506
2017/0002582 A1 1/2017 Baldoni et al.

OTHER PUBLICATIONS

Written Opinion of the International Searching Authority, dated Oct. 7, 2016, for International Application No. PCT/US2016/036316.
European Search Report dated Feb. 8, 2019 for European Patent Application No. 16808145.3, 11 pages.

* cited by examiner

MOLDING SYSTEM FOR SWIMMING POOL COPINGS

CROSS REFERENCE TO RELATED APPLICATIONS

This application is a continuation of U.S. patent application Ser. No. 15/580,844, filed Dec. 8, 2017 which is a U.S. National Stage of International Application No. PCT/US2016/036316, filed Jun. 8, 2016, which claims the benefit of U.S. Provisional Patent Application No. 62/174,210, filed Jun. 11, 2015, each of which is hereby incorporated by reference in its entirety.

FIELD OF THE INVENTION

The present invention, according to some embodiments, relates to a molding system for swimming pool copings. In some embodiments, the present invention relates to a molding system for molding a top of a swimming pool coping. In some embodiments, the present invention provides a molding system for a swimming pool coping particularly having a track for receiving a pool cover. In other embodiments, the present invention provides a tool for removing the molding system.

SUMMARY OF THE INVENTION

In some embodiments, the present invention provides a molding system for a swimming pool coping having a track for receiving a pool cover. In some embodiments, the molding system includes an adaptor that is sized and configured to be positioned at least partially within the track. The adaptor, according to some embodiments, includes a front wall configured to be inserted into the track, a lower portion extending from a bottom of the front wall, and an upper portion extending from a top of the front wall and spaced apart from the lower portion. In further embodiments, the upper portion and the lower portion defining a channel there between. In some embodiments, an upper flange extends from the upper portion.

In certain embodiments, a molding system according to the present invention further includes a back panel having a front surface and a back surface, the back panel being configured to engage with the adaptor and having at least one clip defining a slot for receiving the upper flange of the adaptor when the back panel is engaged with the adaptor. In some such embodiments, the at least one clip is positioned on the back surface of the back panel. The back panel may further include a ledge extending from the front surface of the back panel proximate a top of the back panel. In yet further embodiments, the molding system includes a molding block positionable on the upper portion of the adaptor, the molding block having a mold surface configured to mold a predetermined contour into a material (e.g., concrete).

In some embodiments, the upper portion includes a support surface that is perpendicular to the upper flange, the support surface and the upper flange being configured to extend outside of the track when the front wall is inserted into the track. In some embodiments, the track includes a ridge, and the upper portion includes groove configured to receive the ridge. In some embodiments, at least a portion of the lower portion and the upper portion tapers toward the front wall. In some embodiments, a front portion of the lower portion and a front portion of the upper portion taper towards the front wall. In some embodiments, the upper portion includes an exterior step configured to abut against an upper end of the track. In some embodiments, the adaptor further includes a lower flange extending from the lower portion. The lower flange, in some embodiments, is configured to abut against a lower end of the track. In some embodiments, the lower portion and the upper portion are configured to flex toward each other. In some embodiments, the upper portion is at least partially parallel with the lower portion.

A molding system according to some embodiments of the present invention may further include a spacer that may be removably engaged with the adaptor. In some embodiments, the molding system includes a spacer sized and configured to be at least partially positioned in the channel defined between the lower portion and the upper portion of the adaptor. In some embodiments, the spacer is sized and configured to abut against the lower portion and the upper portion when the spacer is positioned in the channel. In further embodiments, the spacer includes a biasing element configured to abut against the lower portion or the upper portion of the adaptor when the spacer is positioned in the channel. In some such embodiments, the biasing element is a cantilever spring. The cantilever spring, in some embodiments, includes a free end and a fixed end, the fixed end connected to a top of a front support. In some embodiments, the spacer further includes a base connected to a bottom of the front support, the cantilever spring being configured to abut against the upper portion of the adaptor, and the base being configured to abut against the lower portion of the adaptor when the spacer is positioned in the channel. In some embodiments, the rear support has a height larger than a height of the front support. In some embodiments, the rear support is connected to the base by a connector. In some embodiments, the spacer includes a closeable gap between the free end of the cantilever spring and the connector.

In other embodiments, the spacer includes a base having a top side and a bottom side, and a plurality of supports extending from the top side. The plurality of supports may include a first support, a second support, and a third support, according to some embodiments, wherein the first support and third supports are positioned at opposite ends of the base and the second support is positioned between the first support and the third support. In some such embodiments, the second support and the third support are substantially perpendicular to the base. In some embodiments, the first support includes a first portion that is substantially perpendicular to the base and a second portion that is obliquely angled with respect to the first portion. In some embodiments, the second support has a height greater than a height of the first support, and the first support has a height greater than the third support. In some embodiments, the spacer further includes a bottom support extending from the bottom side of the base, a first lip extending from one side of the bottom support, and a second lip extending from a second side of the bottom support. Each of the first lip and the second lip forms an acute angle with the bottom support according to some embodiments. In some embodiments, the first lip defines a first slot with the bottom side of the base, the second lip defines a second slot with the bottom side of the base, and the lower portion of the adaptor is configured to be received within the first slot or the second slot. In some embodiments, the first support and the second support are configured to be positioned between the upper portion and the lower portion of the adaptor when the lower portion of the adaptor is received in the first slot. In some embodiments, the third support is configured to be positioned between the upper portion and the lower portion of the adaptor when the lower portion of the adaptor is received in the second slot.

Further embodiments of the present invention relate to a tool for removing a molding system from a swimming pool coping. In some embodiments, a tool according to the present invention includes a blade having a top surface, a substantially planar bottom surface, and an edge. A base is connected to the blade opposite the edge, the base having an abutment arranged substantially coplanar with the bottom surface of the blade. A handle is connected to the blade, the handle being disposed along an axis that is obliquely angled with respect to the bottom surface. In some embodiments, the top surface and the bottom surface of the blade taper towards the edge. In some embodiments, the abutment includes a sleeve or coating. In further embodiments, the tool also includes a shaft connecting the handle to the top surface of the blade. In some embodiments, the shaft includes a first portion connected to the top surface of the blade, the first portion extending substantially perpendicular to the bottom surface of the blade. In some embodiments, the shaft further includes a second portion extending substantially perpendicular from the first portion and substantially parallel to the bottom surface of the blade. In yet other embodiments, the shaft further includes a third portion extending from the second portion, the third portion disposed along the axis that is obliquely angled with respect to the bottom surface. In some such embodiments, the handle is disposed about the third portion of the shaft.

BRIEF DESCRIPTION OF THE DRAWINGS

The foregoing summary and the following detailed description of the invention will be better understood when read in conjunction with the appended drawings. For the purpose of illustrating the invention, there are shown in the drawings embodiments which are presently preferred. It should be understood, however, that the invention can be embodied in different forms and thus should not be construed as being limited to the embodiments set forth herein.

DETAILED DESCRIPTION

Figure 1:
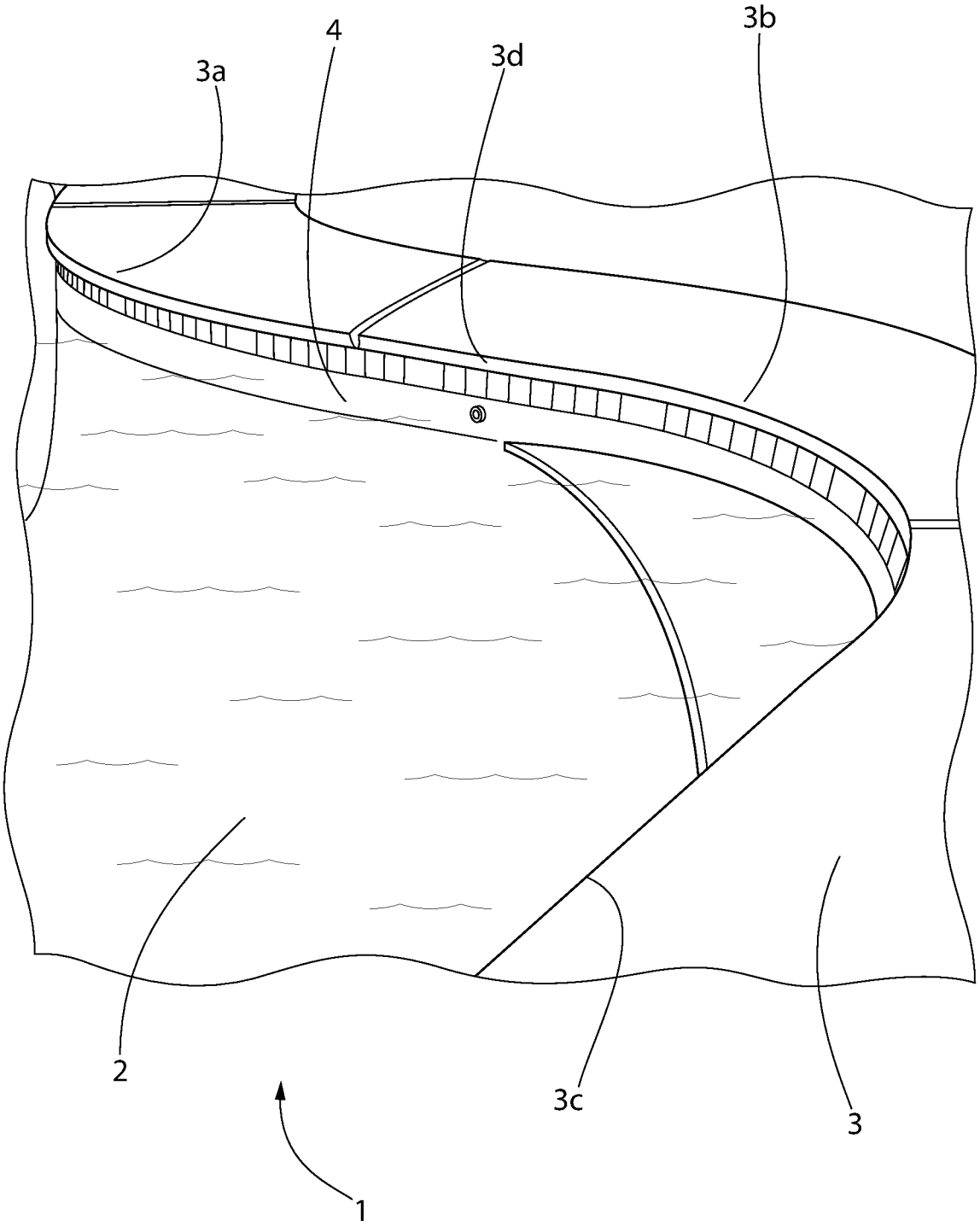
FIG. 1 illustrates an exemplary swimming pool in accordance with an embodiment of the present invention.

The present invention will now be described more fully hereinafter with reference to the accompanying Figures in which representative embodiments are shown and wherein like reference numerals indicate like elements throughout. The present invention can, however, be embodied in different forms and should not be construed as limited to the embodiments set forth herein. Rather, these embodiments are provided to describe and enable one of skill in the art. All publications, patent applications, patents, and other references mentioned herein are incorporated by reference in their entirety.

FIG. 1 illustrates a swimming pool 1 in accordance with an embodiment of the present invention which includes an interior space 2 configured to be filled with water. Swimming pool 1 further includes a coping around the periphery of interior space having a top 3 that surrounds the perimeter of interior space 2 and caps the walls of the swimming pool which define interior space 2. Top 3 may, for example, include curved sections 3*a* and 3*b* and/or substantially straight sections 3*c* in accordance with the desired shape of interior space 2. Top 3 further includes an edge 3*d* which may extend over and/or into interior space 2.

Figure 2:
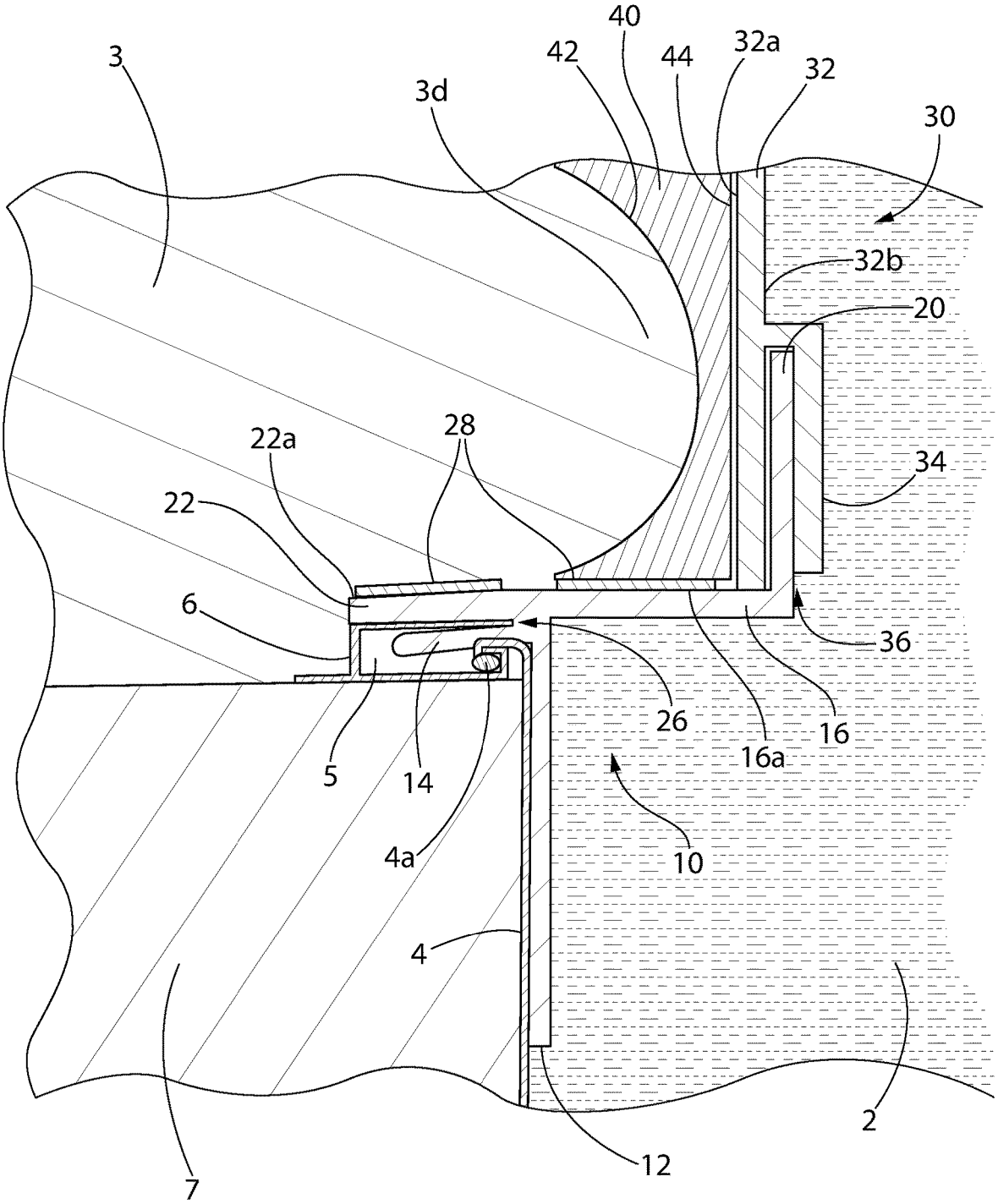
FIG. 2 is a side cross sectional view of a molding system engaged with a swimming pool coping in accordance with an embodiment of the present invention.

In some embodiments, swimming pool 1 further includes a pool liner 4 that is configured to line the walls of swimming pool 1. Pool liner 4 may be configured as a waterproof, flexible sheet and, in some embodiments, may be made from a plastic material (e.g., vinyl). Referring now to FIG. 2, which shows a cross-sectional view of an exemplary swimming pool coping in conjunction with a molding system in accordance with an embodiment of the present invention, the swimming pool coping includes a track 6 defining space 5 configured to receive a top section of pool liner 4. In some embodiments, pool liner 4 includes a bead 4*a* or other element configured to secure pool liner 4 with track 6. Track 6 may extend substantially along the entire periphery of interior space 2 and may be positioned on wall portion 7 of the swimming pool. Top 3 of the swimming pool coping, according to certain embodiments, may be formed from concrete or other similar material which is poured over track 6 and wall portion 7, molded into its final desired shape, and allowed to set.

Referring now to FIGS. 2-7, there is shown a molding system for a swimming pool coping in accordance with exemplary embodiments of the present invention. The molding system according to certain embodiments of the present invention is particularly useful for molding the top of a swimming pool coping, for example, top 3 described above. In certain preferred embodiments of the present invention, the molding system includes a molding platform 10 that is configured to engage with the swimming pool coping. In some embodiments, the molding system further includes a backing 30 that is configured to engage with molding platform 10. In further embodiments, the molding system includes a molding block 40 positionable on molding platform 10 as will be described herein.

As shown particularly in FIGS. 2-6, molding platform 10 in some embodiments may include a panel 12 having a first side 12*a* and a second side 12*b* opposite first side 12*a*. First side 12*a* and second side 12*b* may be substantially rectangular in shape or may be configured as another polygonal shape. In other embodiments, panel 12 may include one or more curved edges. In some embodiments, panel 12 is a flexible panel such that first side 12*a* and second side 12*b* can be curved convexly and/or concavely, and is preferably configured to substantially conform to a curvature of a swimming pool wall. When molding platform 10 is in an unflexed or relaxed state, according to some embodiments, each of first side 12*a* and second side 12*b* is substantially planar.

Figure 3:
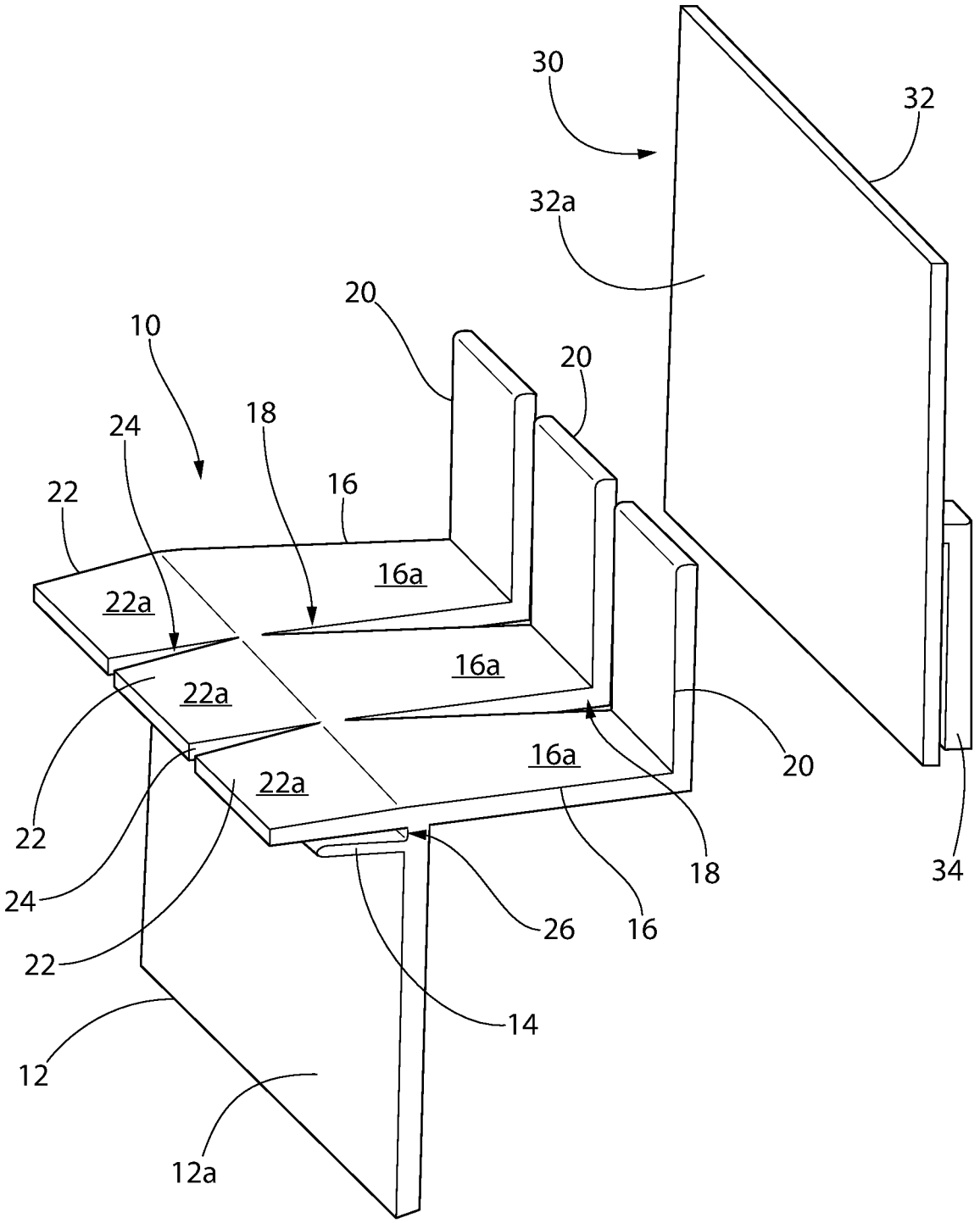
FIG. 3 is an exploded front perspective view of a molding platform and backing in accordance with an embodiment of the present invention.
Figure 4:
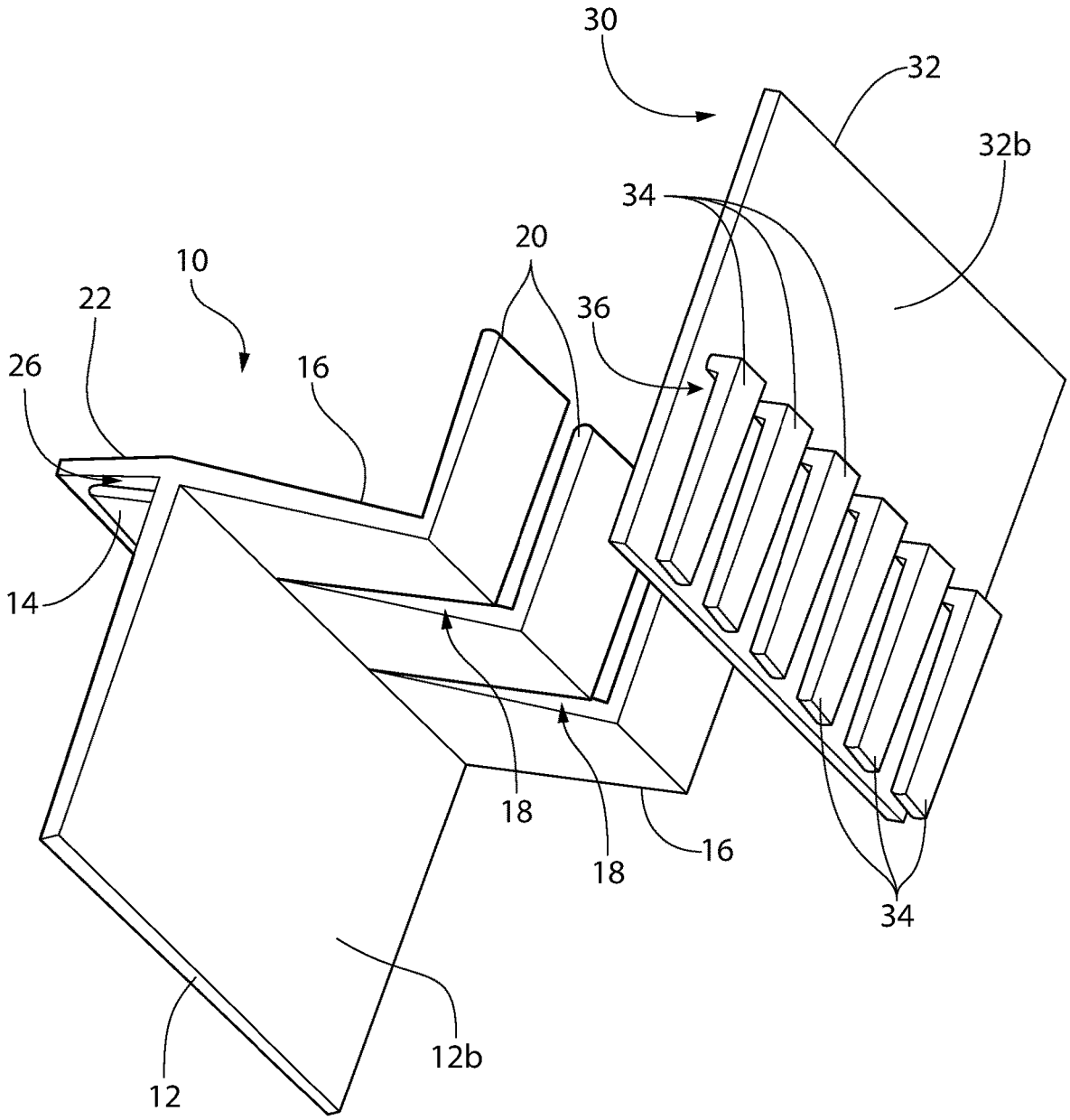
FIG. 4 is an exploded rear perspective view of the molding platform and backing of FIG. 3.
Figure 6:
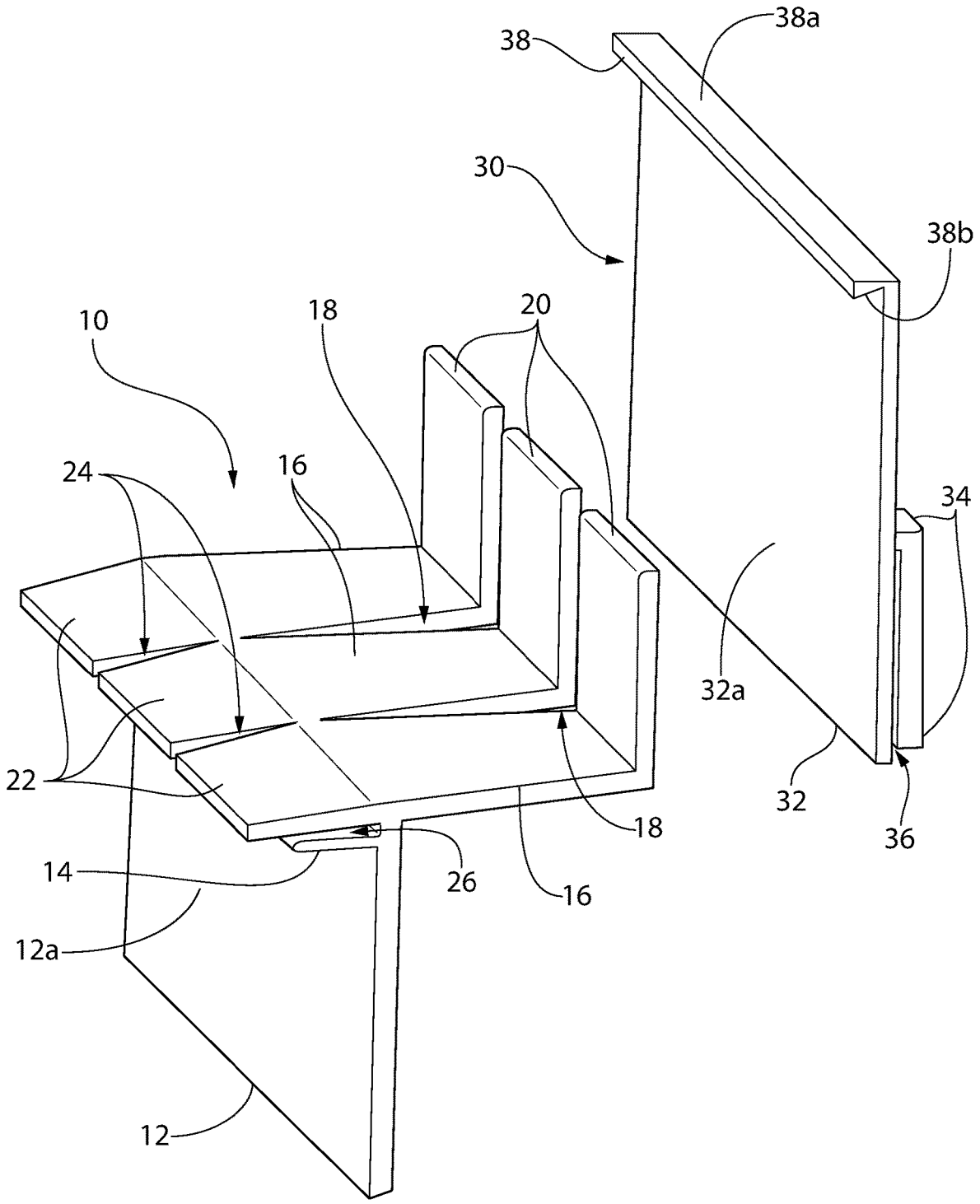
FIG. 6 is an exploded front perspective view of a molding platform and backing in accordance with another embodiment of the present invention.

In some embodiments of the present invention, molding platform 10 includes one or more mold supports 16. Molding platform 10, in certain preferred embodiments, includes a plurality of mold supports 16 that are configured to support one or more molding blocks 40 (see, e.g., FIG. 2). Mold supports 16 may be formed integrally with panel 12, or formed separately from panel 12 and secured thereto using any suitable means known in the art (e.g., adhesive, fasteners, joinery techniques, welding, etc.). In some embodiments, mold supports 16 are arranged in a row proximate a top of panel 12, for example, as shown in FIGS. 3, 4, 6, and 7. In some embodiments, mold supports 16 extend from second side 12*b* of panel 12 and may be substantially perpendicular to panel 12. Top surfaces 16*a* of the plurality of mold supports 16 are substantially coplanar according to some embodiments, and are configured to support one or more molding blocks 40. In some embodiments, top surfaces 16*a* are continguous with the top edge of panel 12. In some embodiments, top surfaces 16*a* are substantially perpendicular to second side 12*b* of panel 12. In some embodiments, each mold support 16 is configured as a cantilever having a length L1 extending from second side 12*b* of panel 12. For ease of illustration FIGS. 3, 4, and 6 show only three mold supports 16, however, it should be appreciated that molding platform 10 may include any suitable number of mold supports 16. In some embodiments, molding platform 10 includes at least two mold supports 16, at least three mold supports 16, at least four mold supports 16, at least five mold supports 16, at least six mold supports 16, at least seven mold supports 16, at least eight mold supports 16, at least nine mold supports 16, at least ten mold supports 16, at least eleven mold supports 16, or at least twelve mold supports 16. In certain preferred embodiments, mold supports 16 are spaced evenly along the top of panel 12. In some embodiments, each of the plurality of mold supports 16 is configured substantially the same.

Referring again to FIGS. 3, 4, 6, and 7, in some embodiments, adjacent mold supports 16 are separated by a gap 18. In some embodiments, each gap 18 has a length equal to the length of each mold support 16 (e.g., L1 in FIG. 7). In other embodiments, gap 18 has a length shorter than the length of each mold support 16 (e.g., less than L1). Gaps 18 in some embodiments are configured to provide a degree of clearance between adjacent mold supports 16 to allow for molding platform 10 to be curved, for example, in directions C1 and C2 depicted in FIG. 7. This may be advantageous according to certain embodiments, for example, when molding platform 10 is engaged with a swimming pool coping along a curved section of the swimming pool (e.g., sections 3*a* and 3*b* of FIG. 1).

Figure 7:
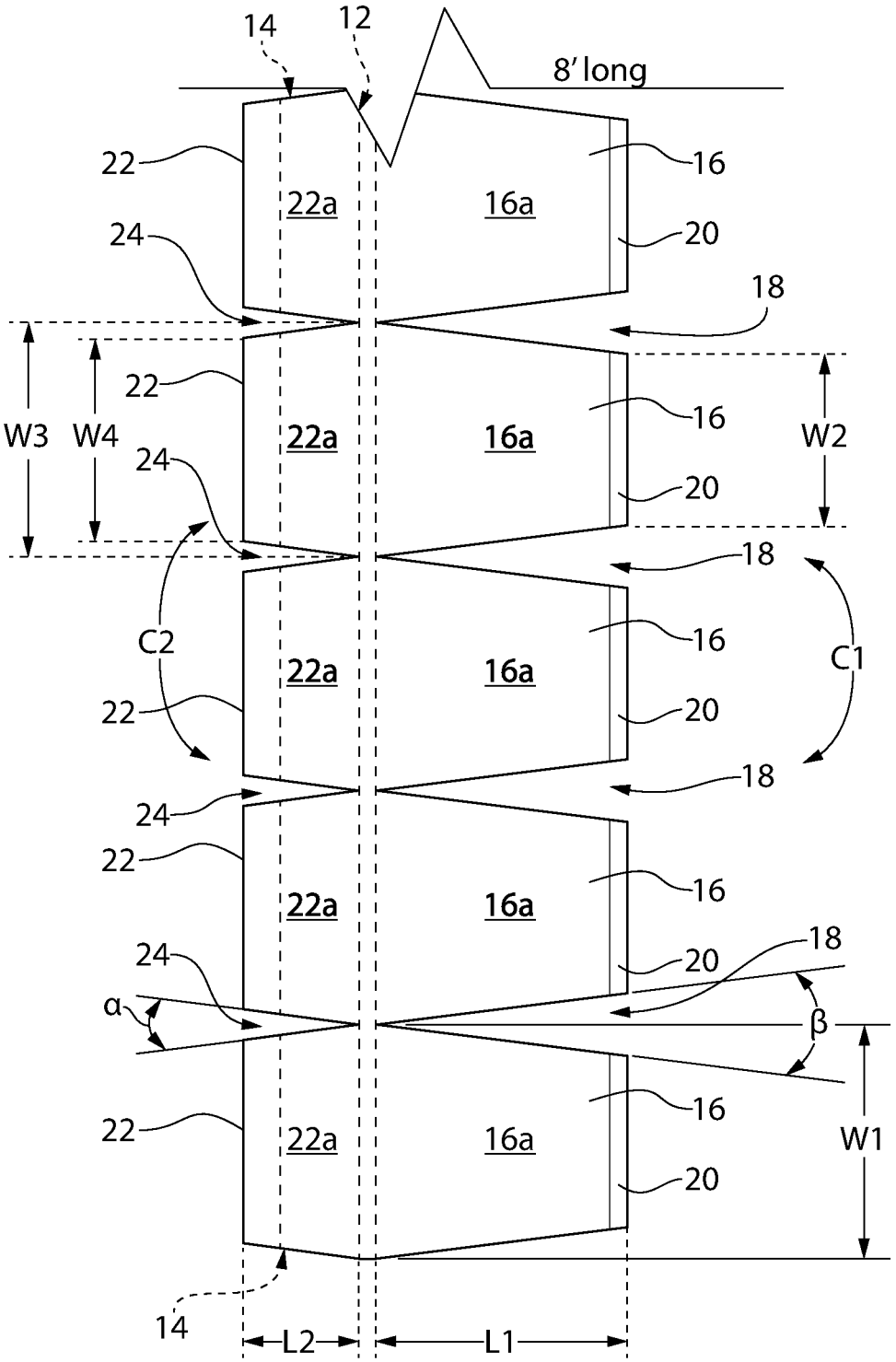
FIG. 7 is a top plan view of a molding platform in accordance with another embodiment of the present invention.

As further shown in FIG. 7, top surface 16*a* of each mold support 16 in some embodiments may be substantially trapezoidal in shape. According to some of these embodiments, top surface 16*a* has a width that tapers from W1 to W2 as mold support 16 extends away from panel 12, where W1 is greater than W2. In certain preferred embodiments, each top surface 16*a* of the mold supports 16 is substantially configured as an isosceles trapezoid having parallel sides (bases) with dimensions W1 and W2, and a perpendicular distance between the parallel sides (altitude) having a dimension equal to L1. Mold supports 16 according to these embodiments may further include a pair of side edges that extend between and are obliquely angled relative to the parallel sides and which have equal lengths greater than L1. Gap 18 may be defined by angle β formed between adjacent mold supports 16 in the plane of top surfaces 16*a* according to these embodiments. In some embodiments, angle β is equal to the angle between the neighboring side edges of adjacent mold supports 16. In some embodiments, angle β is an acute angle from about 1 to about 45°, about 1 to about 40°, about 1° to about 35°, about 1° to about 30°, about 1° to about 25°, about 1° to about 20°, about 1° to about 15°, about 1° to about 10°, or about 1° to about 5°. In some embodiments, when molding platform 10 is an unflexed or relaxed state, angle β is from about 5° and about 25°, about 10° and about 20°, about 12° and about 18°, or about 14° and about 16°. In one embodiment, angle β is about 140.

In some embodiments, one or more of mold supports 16 of molding platform 10 may further include a flange 20. In some embodiments, fewer than all the mold supports 16 include a flange 20. In some embodiments, each mold support 16 includes a flange 20. Flange 20 in some embodiments is positioned proximate an end of mold support 16 (e.g., an end of mold support 16 furthest away from panel 12) and may extend substantially perpendicular from top surface 16*a*. In some embodiments, each flange 20 has a width substantially equal to W2. In other embodiments, flange 20 has a width less than W2. In some embodiments, flanges 20 are configured to engage with backing 30 as will be described further herein.

Molding platform 10 in some embodiments of the present invention may include one or more coping tabs 22. In some preferred embodiments, molding platform 10 includes a plurality of coping tabs 22. In some embodiments, the number of coping tabs 22 is less than the number of mold supports 16. In other embodiments, the number of coping tabs 22 is greater than the number of mold supports 16. In some preferred embodiments, the number of coping tabs 22 is equal to the number of mold supports 16. In some embodiments, coping tabs 22 are arranged in a row proximate a top of panel 12, for example, as shown in FIGS. 3, 4, 6, and 7. In some embodiments, coping tabs 22 extend from first side 12*a* of panel 12. In some embodiments, each coping tab 22 is configured as a cantilever having a length L2 extending from first side 12*a* of panel 12. In some embodiments, coping tabs 22 extend from first side 12*a* of panel 12 opposite of mold supports 16. In some embodiments, the plurality of coping tabs 22 are substantially aligned with the plurality of mold supports 16 along the top of panel 12, as shown for example in FIGS. 3, 6, and 7. In certain preferred embodiments, coping tabs 22 are spaced evenly along the top of panel 12. In some embodiments, each of the plurality of coping tabs 22 is configured substantially the same. Coping tabs 22 may be formed integrally with panel 12 and/or mold supports 16, or may be formed separated from panel 12 and/or mold supports 16 and secured thereto using any suitable means known in the art (e.g., adhesive, fasteners, joinery techniques, welding, etc.).

Figure 5:
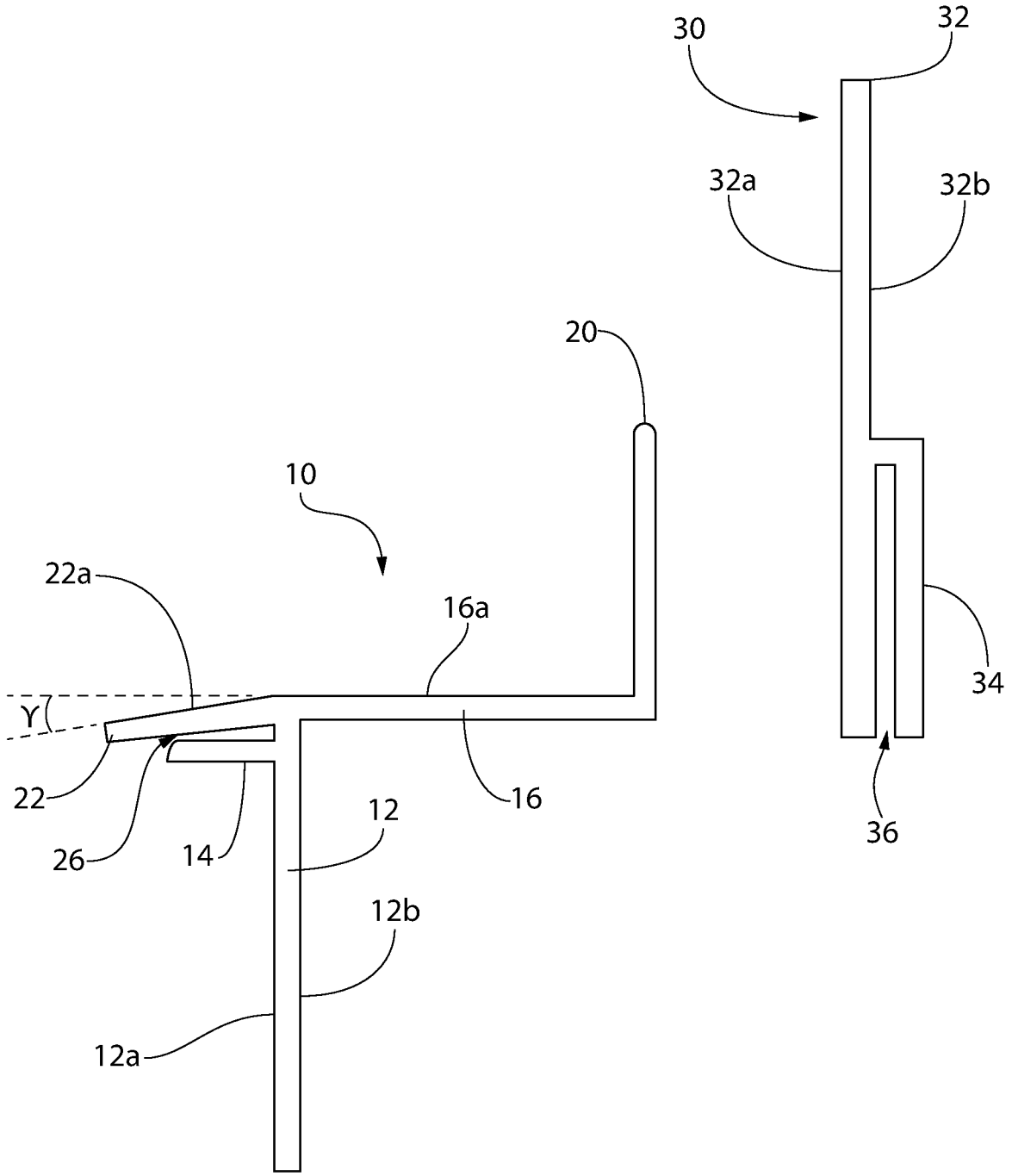
FIG. 5 is an exploded side view of the molding platform and backing of FIGS. 3 and 4.

Top surfaces 22*a* of coping tabs 22 are substantially coplanar according to some embodiments. In some embodiments, top surfaces 22*a* of coping tabs 22 are continguous with top surfaces 16*a* of mold supports 16. In some embodiments, top surfaces 22*a* of coping tabs 22 are continguous with top surfaces 16*a* of mold supports 16 and the top edge of panel 12. In some embodiments, top surfaces 22*a* are substantially perpendicular to first side 12*a* of panel 12. In some embodiments, top surfaces 22*a* are substantially coplanar with top surfaces 16*a*. In other embodiments, top surfaces 22*a* are obliquely angled relative to first side 12*a* of panel 12. In some embodiments, top surfaces 22*a* are obliquely angled relative to first side 12*a* of panel 12 prior to engagement of molding platform 10 with the pool liner track. In some embodiments, top surface 22*a* extends at an incline relative to top surface 16*a*. As shown in FIG. 5, in some embodiments top surface 22*a* of coping tab 22 lies in a first plane and top surface 16*a* of molding support 16 lies in a second plane, wherein angle $\gamma$ between the first plane and the second plane is greater than 0° and less than 90°. In some embodiments, angle $\gamma$ is about 1 to about 10°, about 2° to about 9°, about 3° to about 7°, about 4° to about 6°, or about 5°.

Referring again to FIGS. 3, 6, and 7, in some embodiments, adjacent coping tabs 22 are separated by a gap 24. In some embodiments, each gap 24 has a length equal to the length of each coping tab 22 (e.g., L2 in FIG. 7). In other embodiments, gap 24 has a length shorter than the length of each coping tab (e.g., less than L2). Gaps 24 in some embodiments are configured to provide a degree of clearance between adjacent coping tabs 22 to allow for molding platform 10 to be curved, for example, in directions C1 and C2 depicted in FIG. 7. This again may be advantageous according to certain embodiments, for example, when molding platform 10 is engaged with a swimming pool coping along a curved section of the swimming pool (e.g., curved sections 3*a* and 3*b* of FIG. 1). In some embodiments, gaps 24 are substantially aligned with gaps 18, for example, as can be seen in FIG. 7.

As further shown in FIG. 7, top surface 22*a* of each coping tab 22 in some embodiments may be substantially trapezoidal in shape. According to some of these embodiments, top surface 22*a* has a width that tapers from W3 to W4 as coping tab 22 extends away from panel 12, where W3 is greater than W4. In certain preferred embodiments, each top surface 22*a* of the coping tabs 22 is substantially configured as an isosceles trapezoid having parallel sides (bases) with dimensions W3 and W4, and a perpendicular distance between the parallel sides (altitude) having a dimension equal to L2. Coping tabs 22 according to these embodiments may further include a pair of side edges that extend between and are obliquely angled relative to the parallel sides and which have equal lengths greater than L2. In some embodiments, L2 is less than L1. In some embodiments, W3 is equal to W1. In further embodiments, W4 is greater than W2. Thus, in certain embodiments, W2<W4<W3=W1.

Gap 24 may be defined by angle $\alpha$ formed between adjacent coping tabs 22 in the plane of top surfaces 22*a* according to some of these embodiments. In some embodiments, angle $\alpha$ is equal to the angle between the neighboring side edges of adjacent coping tabs. In some embodiments, angle $\alpha$ is an acute angle from about 1° to about 45°, about 1° to about 40°, about 1° to about 35°, about 1° to about 30°, about 1° to about 25°, about 1° to about 20°, about 1° to about 15°, about 1° to about 10°, or about 1 to about 5°. In some embodiments, when molding platform 10 is an unflexed or relaxed state, angle $\alpha$ is from about 5° and about 25°, about 10° and about 20°, about 12° and about 18°, or about 14° and about 16°. In one embodiment, angle $\alpha$ is about 14°. In some embodiments, angle $\alpha$ is substantially equal to angle $\beta$ when molding platform 10 is an unflexed or relaxed state.

In certain embodiments of the present invention, molding platform 10 further includes at least one lip 14 configured to be received in space 5 defined by track 6 of the swimming pool coping (see, e.g., FIG. 2) when molding platform 10 is engaged with the swimming pool coping. In some embodiments, lip 14 extends from first side 12*a* of panel 12. In some embodiments, lip 14 is substantially perpendicular to first side 12*a* of panel 12. In some embodiments, lip 14 is configured as a cantilever extending from first side 12*a* of panel 12. In some embodiments, lip 14 has a width substantially the same as a width of panel 12. In some embodiments, lip 14 has a width less than the width of panel 12. In some embodiments, lip 14 is integrally formed with panel 12. In further embodiments, lip 14 is formed separately from panel 12 and secured thereto using any suitable means known in the art (e.g., adhesive, fasteners, joinery techniques, welding, etc.). In some embodiments, molding platform 10 includes a plurality of lips 14. In some embodiments, the plurality of lips 14 is arranged in a row on first side 12*a* of panel 12. In some of these embodiments, adjacent pairs of lips 14 are separated by gaps which, for example, may be vertically aligned with gaps 24. In some embodiments, the plurality of lips 14 is spaced evenly substantially across a width of first side 12*a*.

As shown in FIGS. 2-6, in some embodiments lips 14 are vertically aligned with and spaced below coping tabs 22. In some embodiments, molding platform 10 includes an equal number of lips 14 and coping tabs 22. In some embodiments, lips 14 have a length that is shorter than a length of coping tabs such that lips 14 do not extend beyond the ends of coping tabs 22. In some embodiments, coping tabs 22 and lips 14 cooperate to clip onto a portion of the swimming pool coping in order to releaseably secure molding platform 10 with the swimming pool coping. In some embodiments, lips 14 and coping tabs 22 define slot 26 configured to receive a portion of the swimming pool coping when molding platform 10 is engaged with the swimming pool coping. As shown in FIG. 2, for example, slot 26 located between coping tab 22 and lip 14 is configured in some embodiments to receive a portion of track 6 of the swimming pool coping. In some embodiments, molding platform 10 is configured to substantially prevent concrete or other materials from entering into space 5 of track 6 where molding platform 10 is engaged with the swimming pool coping.

As described herein, the molding system of the present invention in some embodiments further includes a backing 30. As shown in FIGS. 3-6, backing 30 in some embodiments includes a back panel 32 having a front surface 32*a* and a back surface 32*b* opposite front surface 32*a*. In some embodiments, back panel 32 is a flexible panel such that front surface 32*a* and back surface 32*b* can be curved convexly and/or concavely. When back panel 32 is in an unflexed or relaxed state, according to some embodiments, each of front surface 32*a* and back surface 32*b* is substantially planar. In some embodiments, front surface 32*a* and back surface 32*b* may be substantially rectangular in shape, or may be configured as another polygonal shape in other embodiments. In some embodiments, back panel 32 has width substantially equal to the width of panel 12.

Backing 30 is configured to engage with molding platform 10 according to some embodiments of the present invention. In some embodiments, backing 30 is configured to be releaseably secured to molding platform 10. In some embodiments, backing 30 includes one or more securements configured to engage with one or more components of molding platform 10 in order to secure backing 30 to molding platform 10. In some embodiments, backing 30 is configured to attach to flanges 20 of mold supports 16. In some embodiments, for example, backing 30 includes at least one clip 34 configured to attach back panel 32 with molding platform 10, preferably a plurality of clips 34. In some embodiments, clips 34 define a slot 36 configured to receive a flange 20 when backing 30 is engaged with molding platform 10 (see, e.g., FIG. 2). In some embodiments, backing 30 includes a plurality of clips 34 arranged in a row on back surface 32*b* of back panel 32, for example, as shown in FIG. 4. Clips 34 may be formed integrally with back panel 32 according to some embodiments, or clips 34 may be formed separately and secured to back panel 32 using any suitable means known in the art (e.g., adhesive, fasteners, joinery techniques, welding, etc.). In some embodiments, the number of clips 34 positioned on back panel 32 is at least equal to the number of flanges 20 present on molding platform 10. In some embodiments, backing 30 includes at least two clips 34 for every flange 20 present on molding platform 10. Six clips 34 and three flanges 20 are shown in the embodiment of FIG. 4 for ease of illustration, however, it should be understood that other embodiments of the inventions can have fewer or more clips 34 and/or flanges 20. In other embodiments of the present invention, backing 30 may be secured to molding platform 10 using other suitable fasteners known in the art, for example, screws, pins, staples, nails, adhesive tape (e.g., double-sided tape), hook-and-loop fasteners (e.g., Velcro®), or the like, which are capable of attaching back panel 32 to flanges 20.

With particular reference now to FIG. 6, in certain embodiments backing 30 further includes ledge 38. In some embodiments, ledge 38 extends from back panel 32 proximate a top of back panel 32. In some embodiments, ledge 38 extends from front surface 32*a* of back panel 32. In some embodiments, ledge 38 spans the entire width of back panel 32. In some embodiments, ledge 38 includes atop surface 38*a*, a bottom surface 38*b*, and a thickness therebetween. Top surface 38*a* of ledge 38 in some embodiments is substantially perpendicular to front surface 32*a* of back panel 32. In some embodiments, ledge 38 is configured such that top surface 38*a* and bottom surface 38*b* are not parallel. In some embodiments, bottom surface 38*b* is oblique relative to top surface 38*a* and/or front surface 32*a*. In some embodiments, the thickness of ledge 38 increases as ledge 38 extends away from back panel 32.

Referring again to FIG. 2, backing 30 in some embodiments is preferably configured to engage with molding platform 10 such that back surface 32*b* of back panel 32 abuts flanges 20 of mold supports 16 while front surface 32*a* of back panel 32 provides an engagement surface for molding block 40 during use of the molding system. In some embodiments, ledge 38 of backing 30 (see FIG. 6) further engages with molding block 40. In some embodiments, molding block 40 snap fits under ledge 38. In some embodiments of the present invention, molding block 40 is positioned on mold supports 16 of molding platform 10 and abuts front surface 32*a* of back panel 32 during use of the molding system. In other embodiments of the present invention, backing 30 is not utilized such that molding block 40 may directly abut against flanges 20 of mold supports 16. In some embodiments, molding block 40 is positioned directly on top surface 16*a* of mold supports 16. In some embodiments, one or more boards 28 are positioned between molding bock 40 and top surface 16*a* of mold supports 16. One or more boards 28, in some embodiments, are configured to cover gaps 18 between adjacent mold supports 16. In some embodiments, one or more boards 28 are also positioned overtop surface 22*a* of coping tabs 22 to cover gaps 24 between adjacent coping tabs 22. In some embodiments, one or more boards 28 are configured to prevent concrete or other materials from passing through gaps 18 and/or gaps 24 during use of the molding system.

Molding block 40 according to certain embodiments of the invention includes a mold surface 42 configured to mold a contour into concrete or other material used to form top 3 of the swimming pool coping, e.g., a predetermined contour. Mold surface 42 may include any desired curvatures and/or patterns suitable for shaping top 3 of the swimming pool coping. As depicted in the embodiment shown in FIG. 2, mold surface 42 may include a profile having a concave curvature, which would impart a convexly curved profile to the edge 3*d* of top 3. However, it should be understood that mold surface 42 in other embodiments may include a profile having convex curvatures and/or straight portions as desired. Mold surface 42 generally faces away from flanges 20 of molding supports 16 when molding block 40 is positioned on molding platform 10 during use. Molding block 40 in some embodiments further includes a back surface 44 opposite mold surface 42. In some embodiments, back surface 44 of molding block 40 is configured to abut against front surface 32*a* of back panel 32 and/or flanges 20 of mold supports 16. Back surface 44 may include a substantially straight profile as shown in FIG. 2 according to some embodiments. In some embodiments, molding block 40 has a height that is substantially equal to the height of back panel 32. In other embodiments, molding bock 40 has a height less than the height of back panel 32. In some embodiments where backing 30 includes ledge 38, for example as shown in FIG. 6, molding block 40 is configured to seat against front surface 32*a* below ledge 38.

In use, according to some embodiments of the present invention, molding platform 10 is first engaged with the coping of a swimming pool. As described herein, in some embodiments molding platform 10 includes at least one lip 14 which is inserted into space 5 defined by track 6 of the swimming pool coping, as shown for example in FIG. 2. According to some of these embodiments, coping tab 22 is positioned over track 6 such that a portion of track 6 is received between coping tab 22 and lip 14 in slot 26. In some embodiments, coping tab 22 is configured to bend away from lip 14 when the portion of track 6 is received within slot 26 (e.g., such that angle γ depicted in FIG. 5 decreases). In some embodiments, the engagement of molding platform 10 with track 6 as described herein secures molding platform 10 to the swimming pool coping. In some embodiments, adhesive tape or other materials and/or fasteners may be used to facilitate securing of molding platform 10 to the swimming pool coping. In some embodiments, front side 12*a* of panel 12 is configured to abut pool liner 4 and/or wall portion 7 when molding platform 10 is secured to the swimming pool coping. In some embodiments, molding platform 10 is configured to curve to match the curvature of the swimming pool walls. For example, as described previously above, in some embodiments gaps 18 and/or gaps 24 are configured to allow bending of molding platform 10. In some embodiments, when molding platform 10 is properly positioned, mold supports 16 extend away from track 6 and into or over interior space 2 of the swimming pool.

After molding platform 10 is secured to the swimming pool coping, backing 30 may be engaged with molding platform 10 according to some embodiments of the present invention. In other embodiments, backing 30 is secured to molding platform 10 prior to engagement of molding platform 10 with the swimming pool coping. As described herein, backing 30 may engage with molding platform 10 using one or more clips 34 arranged on back panel 32 according to some embodiments of the present invention. For example, in some embodiments, flanges 20 of mold supports 16 are received in slot 36 defined by clips 34 such that back surface 32*b* of back panel 32 abuts flanges 20 of mold supports 16.

Molding block 40, in some embodiments, is then positioned on molding platform 10. In some embodiments, molding block 40 is positioned on top surface 16*a* of mold supports 16 such that back surface 44 of molding block 40 faces toward backing 30 and mold surface 42 faces toward the swimming pool coping. In some embodiments, molding block 40 is positioned such that back surface 44 of molding block 44 abuts front surface 32*a* of back panel 32. In some embodiments, molding block 40 and backing 30 are arranged such that back panel 32 is disposed between molding block 40 and flanges 20 of mold supports 16. In some embodiments, one or more boards, tape or other liner 28 is disposed between molding block 40 and mold supports 16. One or more boards 28 may also be positioned over coping tabs 22. Preferably the one or more boards 28 are sized and shaped to cover gaps 18 and/or gaps 24 of molding platform 10.

Concrete or other material used to form top 3 of the swimming pool coping can then be poured over wall portion 7 and track 6, the concrete or other material being at least partially bounded by molding block 40. Preferably the amount of concrete or other material used to form top 3 does not exceed the top of molding block 40 and/or backing 30. As the concrete or other material sets, it is shaped by mold surface 42 of molding block 40 to form edge 3*d*. In some embodiments, molding platform 10, backing 30, and molding block 40 are removed from the swimming pool coping before the concrete or other material completely hardens, for example, to allow the surface of the concrete or other material to be smoothed or textured. Preferably, molding platform 10, backing 30, and molding block 40 of the molding system are reusable. In some embodiments, for example, a molding system can be used to mold one section of the swimming pool coping at a time. In other embodiments, the molding system may extend along the entire swimming pool coping. In some embodiments, a molding system of the present invention is modular such that a plurality of molding platforms 10, backings 30, and/or molding blocks 40 are used to mold the swimming pool coping.

In some embodiments, molding systems of the present invention may also be used for molding the copings of swimming pools that do not include a track configured to receive a pool liner. These swimming pools may include, for example, certain concrete or fiberglass swimming pools which do not use or require a pool liner. According to some embodiments, molding systems of the present invention may be used with such swimming pools by providing a receiver track adapted to receive the molding systems. In some embodiments, the receiver track is configured to be secured to a top periphery of the swimming pool and engage with a molding system. The receiver track, in some embodiments, defines a slot, groove, channel, or the like configured to receive a portion of the molding system, for example, molding platform 10. In some embodiments, the receiver track is preferably positioned relative to the swimming pool such that the slot, groove, channel, or the like is open towards the swimming pool interior. In some embodiments, the receiver track includes one or more elements configured to be received within slot 26 of molding platform 10. In some embodiments, the receiver track is configured to engage with lip 14 and/or coping tabs 22 of molding platform 10 in a manner similar to track 6 shown in the embodiment of FIG. 2. Unlike track 6, however, the receiver track may not include any features particularly configured to secure a pool liner (e.g., pool liner 4). For example, the receiver track may not be shaped or configured to secure bead 4*a* of pool liner 4. In some embodiments, the receiver track may be configured to be positioned on wall portion 7 in the place of track 6 in FIG. 2. In some embodiments, the receiver track may include one or more flanges that can be secured to wall portion 7 when the receiver track is positioned on wall portion 7.

The receiver track and other components of the present invention can be fabricated from a variety of materials. For example, the receiver tracks and molding systems may be made from or include portions made from metal, plastics, polymers, wood, fiberglass, or composites. Other structurally sturdy materials, preferably with a degree of flexibility, may also be used to form components of the present invention. In some embodiments, the receiver tracks, molding systems, and/or one or more components thereof may be white or have a substantially light color so as to absorb less heat than components that are black or a substantially dark color. Components of the present invention may be prefabricated or, in other embodiments, may be assembled by the user. In some embodiments, the receiver tracks and molding systems of the present invention may be provided together in kits.

Figure 8A:
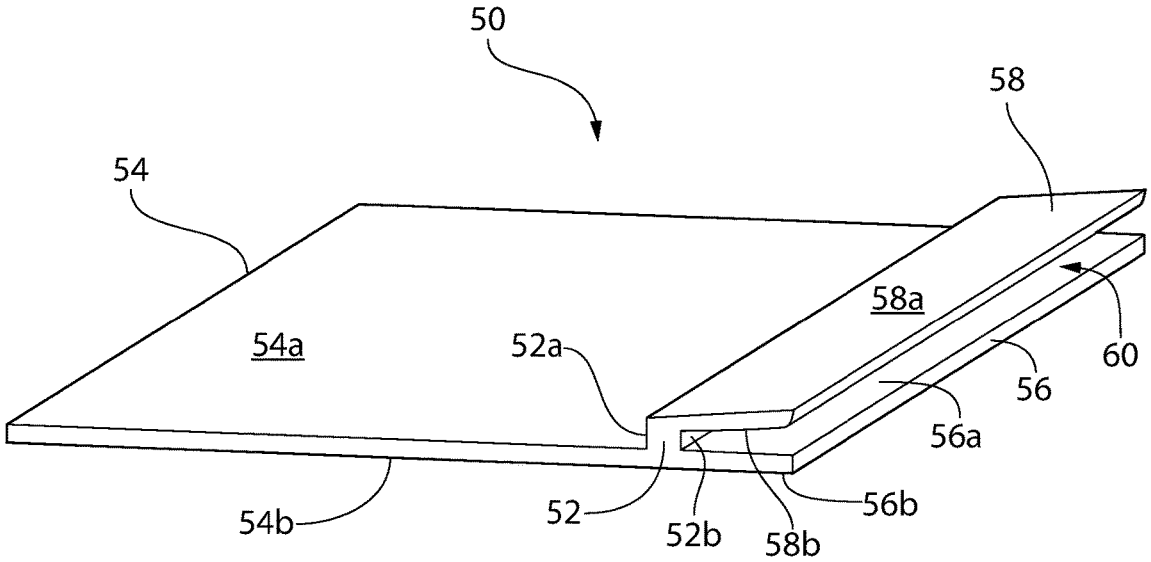
FIG. 8*a* is a perspective view of a receiver track in accordance with an embodiment of the present invention.
Figure 8B:
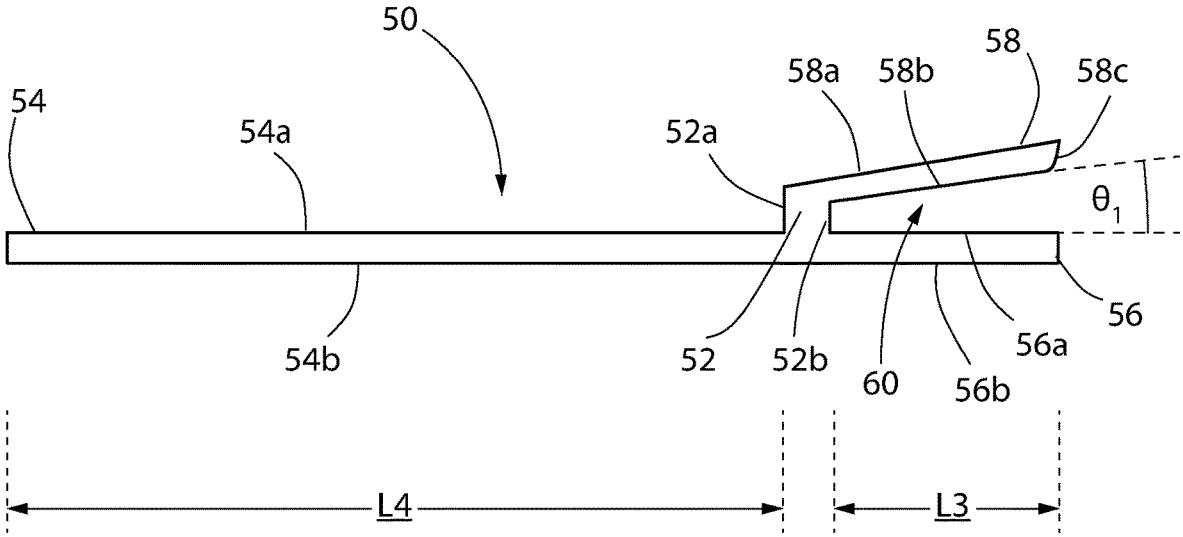
FIG. 8*b* is a side view of the receiver track of FIG. 8*a;*

FIGS. 8*a* and 8*b* show an example receiver track 50 in accordance with one embodiment of the present invention. Receiver track 50, in some embodiments, is particularly adapted to be used with the molding systems described herein. In some embodiments, receiver track 50 is configured to be used along straight sections of a swimming pool (e.g., straight section 3*c* of FIG. 1). In certain embodiments, receiver track 50 is configured to be positioned on a wall portion surrounding the swimming pool, for example, wall portion 7 of FIG. 2.

Receiver track 50, according to certain preferred embodiments, defines a space 60 that is configured to receive and engage with the molding systems described herein. Space 60 may be configured as, for example, a gap, slot, groove, channel or the like. In some embodiments, space 60 is configured to receive a portion of molding platform 10. For example, space 60 may be sized and configured to receive lips 14 and/or coping tabs 22 of molding platform 10. Receiver track 50 is preferably positionable relative to the swimming pool (e.g., along the swimming pool periphery) such that space 60 opens towards the swimming pool interior. In some embodiments, space 60 is disposed between two or more tabs, as will be described further herein.

In some embodiments, space 60 is defined in part by a support 52. In some embodiments, receiver track 50 includes a support 52 having a first side 52*a* and a second side 52*b* opposite first side 52*a*. First side 52*a* may be substantially parallel to second side 52*b* according to some embodiments. In further embodiments, support 52 extends along an entire dimension (e.g., width) of receiver track 50. Support 52, in some embodiments, is substantially rigid, and first side 52*a* and second side 52*b* may be substantially flat. In other embodiments, support 52 is flexible such that first side 52*a* and second side 52*b* can be curved convexly and/or concavely. In some embodiments, space 60 is defined in part by second side 52*b*.

In some embodiments, receiver track 50 includes a lower tab 56. In some embodiments, lower tab 56 extends from support 52 at or proximate the bottom of support 52. In some embodiments, lower tab 56 extends a length L3 from second side 52*b* of support 52. In some embodiments, length L3 is less than length L2 of coping tabs 22. In other embodiments, length L3 is greater than or equal to length L2 of coping tabs 22. Lower tab 56 may be integrally formed with support 52 in some embodiments. In other embodiments, lower tab 56 is formed separately from support 52 and secured thereto using any suitable means known in the art (e.g., adhesive, fasteners, joinery techniques, welding, etc.). In some embodiments, receiver track 50 includes only one lower tab 56. In some embodiments, lower tab 56 has a width that extends along an entire dimension (e.g., width) of receiver track 50 and/or support 52.

In some embodiments, lower tab 56 includes a top surface 56*a* and a bottom surface 56*b*. Top surface 56*a* and bottom surface 56*b* may be substantially parallel according to some embodiments. In some such embodiments, top surface 56*a* and bottom surface 56*b* are substantially perpendicular to second side 52*b* of support 52. Top surface 56*a* and/or bottom surface 56*b* may be substantially rectangular in shape or may be configured as another polygonal shape (e.g., square, trapezoid, etc.). According to these embodiments, lower tab 56 includes one or more straight edges. In further embodiments, lower tab 56 may include one or more curved edges.

In some embodiments, receiver track 50 includes an upper tab 58. In some embodiments, upper tab 58 extends from support 52 at or proximate a top of support 52. In some embodiments, upper tab 58 extends from second side 52*b* of support 52 and is vertically spaced above lower tab 56. Upper tab 58 may be integrally formed with support 52 in some embodiments. In other embodiments, upper tab 58 is formed separately from support 52 and secured thereto using any suitable means known in the art (e.g., adhesive, fasteners, joinery techniques, welding, etc.). In some embodiments, receiver track 50 includes only one upper tab 56. In some embodiments, upper tab 58 has a width that extends along an entire dimension (e.g., width) of receiver track 50 and/or support 52.

In some embodiments, upper tab 58 includes a top surface 58*a* and a bottom surface 58*b*. Top surface 58*a* and bottom surface 58*b* may be substantially parallel according to some embodiments. In some embodiments, top surface 58*a* and bottom surface 58*b* are substantially perpendicular to second side 52*b* of support 52. In other embodiments, as illustrated in FIGS. 8*a* and 8*b*, upper tab 58 extends obliquely from second side 52*b* of support 52. In some embodiments, bottom surface 58*b* of upper tab 58 is obliquely angled with respect to top surface 56*a* of lower tab 56. In some embodiments, bottom surface 58*b* of upper tab 58 and top surface 56*a* of lower tab 56 define an acute angle $\theta_1$ therebetween. In some embodiments, $\theta_1$ is from about 0° to about 10°, from about 1° to about 9°, from about 2° to about 8°, from about 3° to about 7°, from about 4° to about 6, or about 5°. In some embodiments, top surface 58*a* and/or bottom surface 58*b* may be substantially rectangular in shape or may be configured as another polygonal shape (e.g., square, trapezoid, triangle, etc.). According to these embodiments, upper tab 58 includes one or more straight edges. In further embodiments, upper tab 58 may include one or more curved edges. In some embodiments, upper tab 58 includes a front edge 58*c* that may be convexly curved or radiused as shown in FIG. 8*b*.

In some embodiments, space 60 of receiver track 50 is disposed between upper tab 58 and lower tab 56. More particularly, in some embodiments, space 60 is at least partially defined by bottom surface 58*b* of upper tab 58 and top surface 56*a* of lower tab 56. As shown in the illustrated embodiment of FIGS. 8*a* and 8*b*, space 60 extends from second side 52*b* of support 52 a distance equal to length L3. In some embodiments, space 60 further extends along an entire dimension (e.g., width) of receiver track 50. In some embodiments, as discussed above, space 60 is configured to receive a portion of the molding systems described herein. In some embodiments, space 60 is configured to receive and secure to a portion of the molding systems in a friction fit. For example, in some embodiments space 60 is sized and configured to receive lips 14 of molding platform 10. According to some of these embodiments, when lips 14 are received in space 60, upper tab 58 may be received in slot 26 of molding platform 10 between lips 14 and coping tabs 22. In some embodiments, lower tab 56 and upper tab 58 cooperate to clip onto lips 14. In some embodiments, lips 14 and coping tabs 22 cooperate to clip onto upper tab 58. In certain variations, space 60 may be sized and configured to receive coping tabs 22. In these embodiments, when coping tabs 22 are received in space 60, lower tab 56 may be received in slot 26 of molding platform 10 between lips 14 and coping tabs 22. Molding platform 10 may further be combined with backing 30 and molding block 40 before or while engaged with space 60 of receiver track 50. Preferably, receiver track 50 is positioned during use such that mold supports 16 extend into or over the interior space of the swimming pool when molding platform 10 is engaged with receiver track 50.

In some embodiments, receiver track 50 further includes a track flange 54 that extends from first side 52*a* of support 52 a length L4. In some embodiments, length L4 is greater than length L3. In some embodiments, length L4 is greater than length L1 of mold supports 16. In other embodiments, length L4 is less than or equal to length L1. In some embodiments, track flange 54 is positioned at or proximate the bottom of support 52 and extends opposite of lower tab 56. In some embodiments, track flange 54 is integrally formed with support 52 and/or lower tab 56. In other embodiments, track flange 54 is formed separately from support 52 and/or lower tab 56 and secured thereto using any suitable means known in the art (e.g., adhesive, fasteners, joinery techniques, welding, etc.). In the embodiment shown, receiver track 50 includes only one track flange 54. In some embodiments, track flange 54 has a width that extends along an entire dimension (e.g., width) of receiver track 50 and/or support 52.

In some embodiments, track flange 54 includes a top surface 54*a* and a bottom surface 54*b*. Top surface 54*a* and bottom surface 54*b* may be substantially parallel according to some embodiments. In certain embodiments, top surface 56*a* of lower tab 56 is substantially coplanar with top surface 54*a* of track flange 54. In some embodiments, bottom surface 56*b* of lower tab 56 is substantially coplanar with bottom surface 54*b* of track flange 54. In some such embodiments, top surface 54*a* and bottom surface 54*b* are substantially perpendicular to first side 52*a* of support 52. Top surface 54*a* and/or bottom surface 54*b* may be substantially rectangular in shape or may be configured as another polygonal shape (e.g., square, trapezoid, triangle, etc.). According to these embodiments, track flange 54 includes one or more straight edges. In further embodiments, track flange 54 may include one or more curved edges.

In some embodiments, track flange 54 is configured to be secured to the periphery of a swimming pool once receiver track 50 is arranged in its desired position. For example, track flange 54 may be secured to wall portion 7 in FIG. 2 when receiver track 50 is used in place of track 6. In some embodiments, track flange 54 may be secured into position by any suitable means known in the art, for example, using screws, nail, bolts, glue, cement, tape, etc. Preferably receiver track 50 is positioned such that space 60 opens towards the swimming pool interior. After receiver track 50 is secured into position, receiver track 50 may be engaged with the molding system as described above.

After the molding system is engaged with receiver track 50, the molding system may be used to mold the coping of the swimming pool in a manner similar to the procedures described above with respect to embodiments where the molding system is engaged with track 6. In certain embodiments, concrete or other material used to form the swimming pool coping can be poured over receiver track 50, which may be left in place along the periphery of the swimming pool. According to some of these embodiments, receiver track 50 forms a part of the finished swimming pool coping. In some embodiments, molding platform 10, backing 30, and molding block 40 are removed from the swimming pool coping before the concrete or other material completely hardens, for example, to allow the surface of the concrete or other material to be smoothed or textured.

Figure 9A:
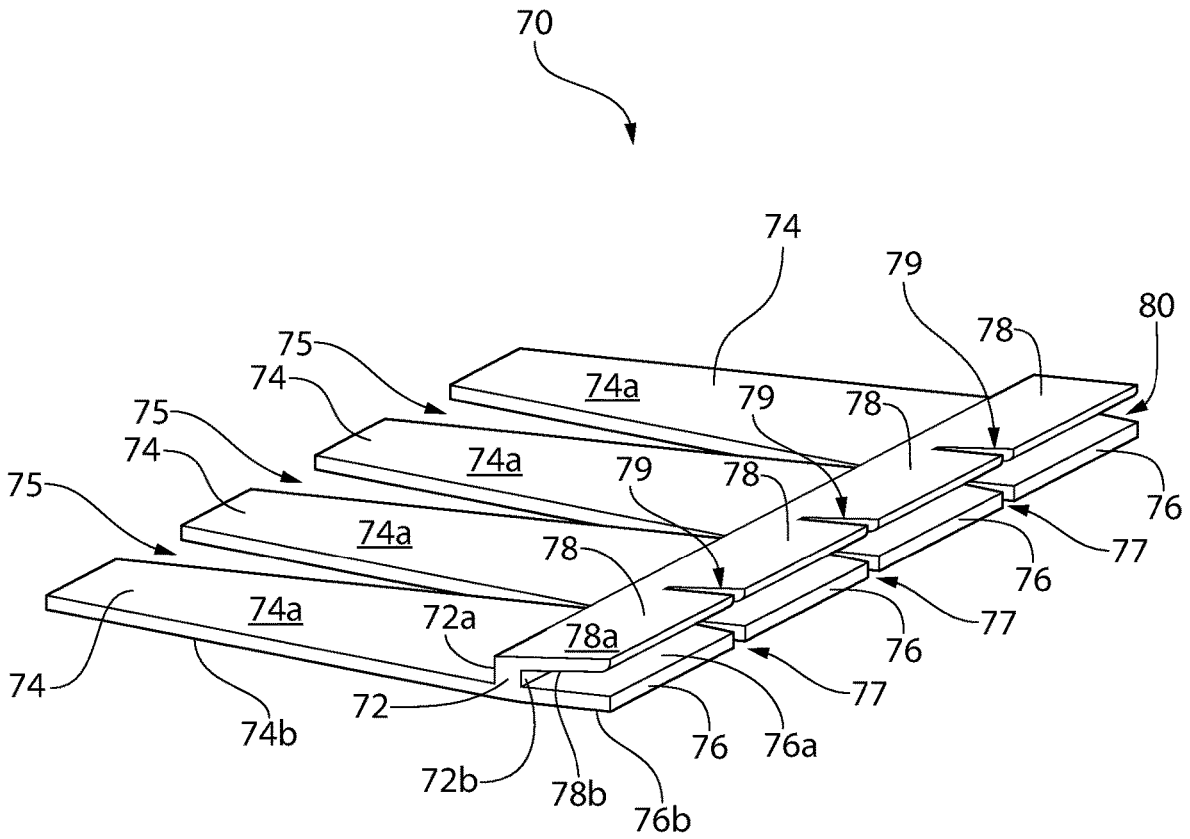
FIGS. 9*a* and 9*b* are perspective views of a receiver track in accordance with a further embodiment of the present invention.
Figure 9B:
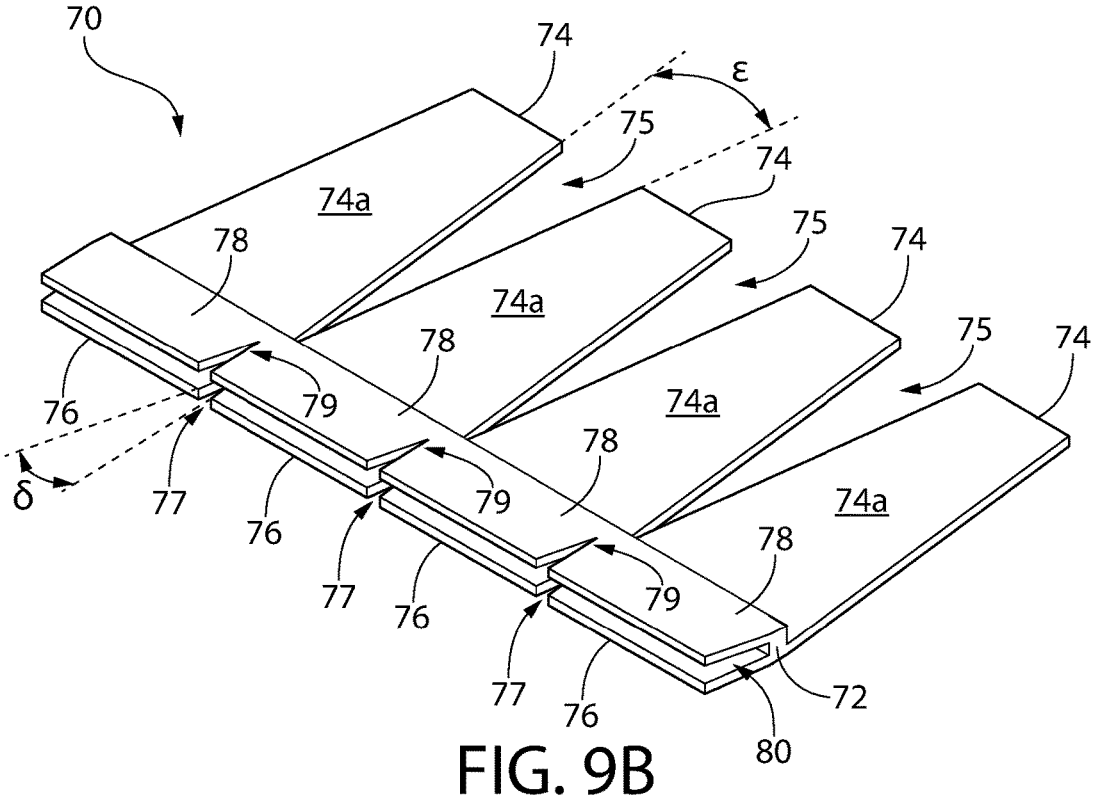
Figure 9C:
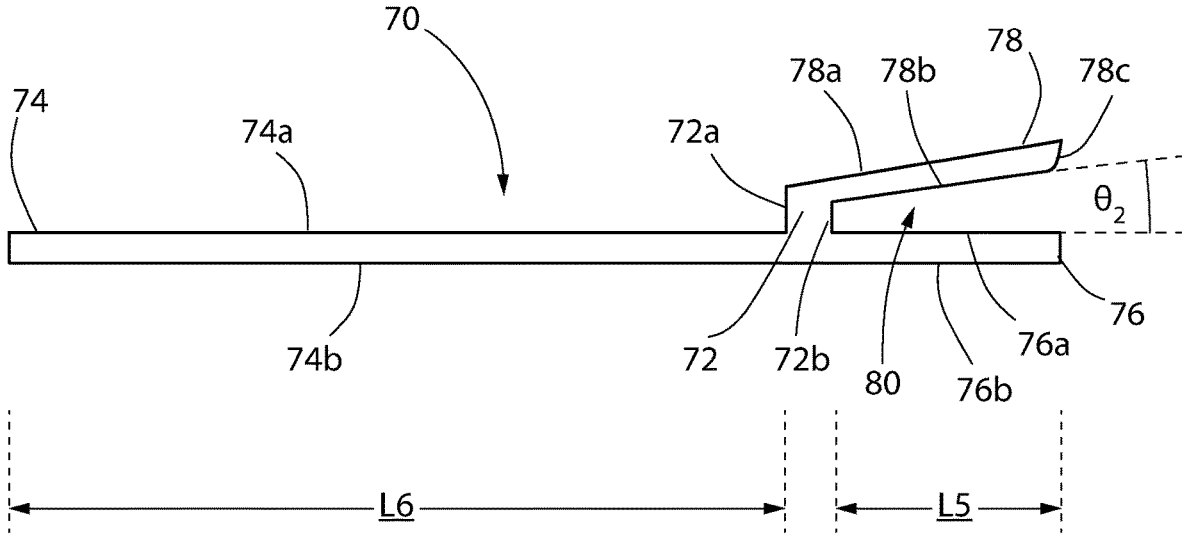
FIG. 9*c* is a side view of the receiver track of FIGS. 9*a* and 9*b;*

FIGS. 9*a*-9*c* show a second example receiver track 70 in accordance with further embodiments of the present invention for use with the molding systems described herein. In some embodiments, receiver track 70 is configured to be used along straight and/or curved sections of a swimming pool. In certain embodiments, receiver track 70 is configured to be positioned on a wall portion of the swimming pool, for example, wall portion 7 of FIG. 2.

Receiver track 70, according to certain preferred embodiments, defines a space 80 that is configured to receive and engage with the molding systems described herein. Space 80 may be configured as, for example, a gap, slot, groove, channel or the like. In some embodiments, space 80 is configured to clip onto a portion of molding platform 10. For example, space 80 may be sized and configured to clip onto lips 14 and/or coping tabs 22 of molding platform 10. Receiver track 70 is preferably positionable relative to the swimming pool (e.g., along the swimming pool periphery) such that space 80 opens towards the swimming pool interior. In some embodiments, space 80 is disposed between two or more tabs, as will be described further herein.

In some embodiments, space 80 is defined in part by a support 72. In some embodiments, receiver track 80 includes a support 72 having a first side 72*a* and a second side 72*b* opposite first side 72*a*. First side 72*a* may be substantially parallel to second side 72*b* according to some embodiments. In further embodiments, support 72 extends along an entire dimension (e.g., width) of receiver track 70. Support 72, in some embodiments, is substantially flexible such that first side 72*a* and second side 72*b* can be curved convexly and/or concavely when receiver track 70 is in a flexed state. In some embodiments, first side 72*a* and second side 72*b* are substantially planar when receiver track 70 is an unflexed or relaxed state. In some embodiments, space 80 is defined in part by second side 72*b*.

In some embodiments, receiver track 70 includes a plurality of lower tabs 76. For ease of illustration, the embodiment of FIGS. 9*a* and 9*b* shows four lower tabs 76. It should be appreciated, however, that receiver track 70 may include any suitable number of lower tabs 76 according to other embodiments. For example, in other embodiments, receiver track 70 may include more than four lower tabs 76. In some embodiments, receiver track 70 includes fewer than four lower tabs 76. Preferably, receiver track 70 includes at least two lower tabs 76.

In some embodiments, lower tabs 76 extend from support 72 at or proximate the bottom of support 72. In some embodiments, lower tabs 76 are arranged in an evenly spaced row along second side 72*b*. In some embodiments, lower tabs 76 extend a length L5 from second side 72*b* of support 72. In some embodiments, length L5 is less than length L2 of coping tabs 22. In other embodiments, length L5 is greater than or equal to length L2 of coping tabs 22. In some embodiments, length L5 is equal to length L3 of receiver track 50. Lower tabs 76 may be integrally formed with support 72 in some embodiments. In other embodiments, lower tabs 76 are formed separately from support 72 and secured thereto using any suitable means known in the art (e.g., adhesive, fasteners, joinery techniques, welding, etc.). In some embodiments, the plurality of lower tabs 76 are positioned along an entire dimension (e.g., width) of receiver track 70 and/or support 72.

In some embodiments, each lower tab 76 includes a top surface 76*a* and a bottom surface 76*b*. In certain embodiments, top surfaces 76*a* of lower tabs 76 are each coplanar. Likewise, in some embodiments, bottom surfaces 76*b* of lower tabs 76 are each coplanar. Top surface 76*a* and bottom surface 76*b* may be substantially parallel according to some embodiments. In some such embodiments, top surface 76*a* and bottom surface 76*b* are substantially perpendicular to second side 72*b* of support 72. As shown in FIGS. 9*a* and 9*b*, top surface 76*a* and/or bottom surface 76*b* may be substantially trapezoidal in shape. In some embodiments, top surface 76*a* and/or bottom surface 76*b* of each lower tab 76 is shaped as an isosceles trapezoid having a height equal to length L5 and its longer base positioned at second side 72*b* of support 72. In other embodiments, top surface 76*a* and/or bottom surface 76*b* may be configured as another polygonal shape (e.g., square, rectangle, triangle, etc.). According to these embodiments, each lower tab 76 includes one or more straight edges. In further embodiments, each lower tab 76 may include one or more curved edges.

In some embodiments, adjacent lower tabs 76 are separated by a gap 77. In some embodiments, each gap 77 has a length equal to the length of each lower tab 76 (e.g., length L5). In other embodiments, each gap 77 has a length shorter than the length of each lower tab 76 (e.g., shorter than length L5). Gaps 77 in some embodiments are configured to provide a degree of clearance between adjacent lower tabs 76 to allow for receiver track 70 to be curved, for example, when receiver track 70 is in a flexed state. This configuration may be advantageous according to certain embodiments, for example, when receiver track 70 is positioned along a curved section of the swimming pool (e.g., curved sections 3*a* and 3*b* of FIG. 1).

As shown in FIG. 9*b*, gaps 77 may be defined by angle δ formed between adjacent lower tabs 76 according to some embodiments. In some embodiments, angle δ is equal to the angle between the neighboring side edges of adjacent lower tabs 76. In some embodiments, angle δ is an acute angle from about 0° to about 45°, about 0° to about 40°, about 0° to about 35°, about 0° to about 30°, about 0° to about 28°, about 0° to about 25°, about 0° to about 20°, about 0° to about 15°, about 0° to about 10°, or about 0° to about 5°. In some embodiments, when receiver track 70 is in an unflexed or relaxed state, angle δ is from about 5° and about 25°, about 10° and about 20°, about 12° and about 18°, or about 14° and about 16°. In one embodiment, angle δ is about 14° when receiver track 70 is in an unflexed or relaxed state. In some embodiments, angle δ is substantially equal to angle α and/or angle β of molding platform 10 when molding platform 10 and receiver track 70 are both in an unflexed or relaxed state.

Angle δ may be increased or decreased relative to the angle in the unflexed or relaxed state depending on the desired curvature of receiver track 70. For example, when receiver track 70 is used with a concavely curved section of the swimming pool (e.g., curved section 3*b* of FIG. 1), receiver track 70 may be flexed such that the ends of lower tabs 76 converge towards each other and angle δ is decreased. When receiver track is used with a convexly curved section of the swimming pool (e.g., curved section 3*a* of FIG. 1), receiver track 70 is flexed such that the ends of lower tabs 76 diverge away from each other and angle δ is increased.

In some embodiments, receiver track 70 includes a plurality of upper tabs 78. For ease of illustration, the embodiment of FIGS. 9*a* and 9*b* shows four upper tabs 78. It should be appreciated, however, that receiver track 70 may include any suitable number of upper tabs 78 according to other embodiments. For example, in other embodiments, receiver track 70 may include more than four upper tabs 78. In some embodiments, receiver track 70 includes fewer than four upper tabs 78. In some embodiments, receiver track 70 includes at least two upper tabs 78. In certain preferred embodiments, receiver track 70 includes the same number of upper tabs 78 and lower tabs 76.

In some embodiments, each upper tab 78 extend from support 72 at or proximate a top of support 72. In some embodiments, upper tabs 78 are arranged in an evenly spaced row along second side 72*b*. In some embodiments, upper tabs 78 extend from second side 72*b* of support 72 and are vertically aligned with and spaced above lower tabs 76. Upper tabs 78 may be integrally formed with support 72 in some embodiments. In other embodiments, upper tabs 78 are formed separately from support 72 and secured thereto using any suitable means known in the art (e.g., adhesive, fasteners, joinery techniques, welding, etc.). In some embodiments, the plurality of upper tabs 78 are positioned along an entire dimension (e.g., width) of receiver track 70 and/or support 72.

In some embodiments, each upper tab 78 includes a top surface 78*a* and a bottom surface 78*b*. In certain embodiments, top surfaces 78*a* of upper tabs 78 are each coplanar. Likewise, in some embodiments, bottom surfaces 78*b* of upper tabs 78 are each coplanar. Top surface 78*a* and bottom surface 78*b* may be substantially parallel according to some embodiments. In some embodiments, top surface 78*a* and bottom surface 78*b* are substantially perpendicular to second side 72*b* of support 72. In other embodiments, as illustrated in FIGS. 9*a*-9*c*, upper tabs 78 extend obliquely from second side 72*b* of support 72. In some embodiments, bottom surface 78*b* of upper tabs 78 is obliquely angled with respect to top surface 76*a* of lower tabs 76. In some embodiments, bottom surface 78*b* of upper tabs 78 and top surface 76*a* of lower tabs 76 define an acute angle $\theta_2$ therebetween. In some embodiments, $\theta_2$ is from about 0° to about 10°, from about 1° to about 9°, from about 2° to about 8°, from about 3° to about 7°, from about 4° to about 6°, or about 5°.

As shown in FIGS. 9*a* and 9*b*, top surface 78*a* and/or bottom surface 78*b* may be substantially trapezoidal in shape. In some embodiments, top surface 78*a* and/or bottom surface 78*b* of each upper tab 78 is shaped as an isosceles trapezoid having its longer base positioned at second side 72*b* of support 72. In other embodiments, top surface 76*a* and/or bottom surface 76*b* may be configured as another polygonal shape (e.g., square, rectangle, triangle, etc.). According to these embodiments, each upper tab 78 includes one or more straight edges. In further embodiments, each upper tab 78 may include one or more curved edges. In some embodiments, upper tabs 78 include a front edge 78*c* that may be convexly curved or radiused as shown in FIG. 9*c*.

In some embodiments, adjacent upper tabs 78 are separated by a gap 79. In certain preferred embodiments, gaps 79 are substantially aligned with and vertically spaced with gaps 77. Gaps 79 in some embodiments are configured to provide a degree of clearance between adjacent upper tabs 79 to allow for receiver track 70 to be curved, for example, when receiver track 70 is in a flexed state. As described, this configuration may be advantageous according to certain embodiments, for example, when receiver track 70 is positioned along a curved section of the swimming pool (e.g., curved sections 3*a* and 3*b* of FIG. 1).

In some embodiments, gaps 79 are defined by an angle that is equal to angle δ of gaps 77 as described above. In some embodiments, the angle of gaps 79 is configured to increase or decrease to the same extent as angle δ when receiver track 70 is being flexed. Thus, in some embodiments, the angle of gaps 79 is an acute angle from about 0° to about 45°, about 0° to about 40°, about 0° to about 35°, about 0° to about 30°, about 0° to about 28°, about 0° to about 25°, about 0° to about 20°, about 0° to about 15°, about 0° to about 10°, or about 0° to about 5°. In some embodiments, when receiver track 70 is in an unflexed or relaxed state, the angle of gaps 79 is from about 5° and about 25°, about 10° and about 20°, about 12° and about 18°, or about 14° and about 16°. In one embodiment, the angle of gaps 79 is about 14° when receiver track 70 is in an unflexed or relaxed state. In some embodiments, the angle of gaps 79 is substantially equal to angle α and/or angle β of molding platform 10 when molding platform 10 and receiver track 70 are both in an unflexed or relaxed state.

In some embodiments, space 80 of receiver track 70 is disposed between upper tabs 78 and lower tabs 76. More particularly, in some embodiments, space 80 is at least partially defined by bottom surface 78*b* of upper tabs 78 and top surface 76*a* of lower tabs 76. As shown in the illustrated embodiment of FIG. 9*c*, space 80 extends from second side 72*b* of support 72 a distance equal to length L5. In some embodiments, space 80 further extends along an entire dimension (e.g., width) of receiver track 70. In some embodiments, as discussed above, space 80 is configured to receive a portion of the molding systems described herein. In some embodiments, space 80 is configured to receive and secure to a portion of the molding systems in a friction fit. For example, in some embodiments space 80 is sized and configured to receive lips 14 of molding platform 10. According to some of these embodiments, when lips 14 are received in space 80, upper tabs 78 may be received in slot 26 of molding platform 10 between lips 14 and coping tabs 22. In some embodiments, lower tabs 76 and upper tabs 78 cooperate to clip onto lips 14. In some embodiments, lips 14 and coping tabs 22 cooperate to clip onto upper tabs 78. In certain variations, space 80 may be sized and configured to receive coping tabs 22. In these embodiments, when coping tabs 22 are received in space 80, lower tabs 76 may be received in slot 26 of molding platform 10 between lips 14 and coping tabs 22. Molding platform 10 may further be combined with backing 30 and molding block 40 before or while engaged with space 80 of receiver track 70. Preferably, receiver track 70 is positioned during use such that mold supports 16 extend into or over the interior space of the swimming pool when molding platform 10 is engaged with receiver track 70.

In some embodiments, receiver track 70 includes a plurality of track flanges 74. For ease of illustration FIGS. 9*a* and 9*b* show four track flanges 74, however, it should be appreciated that receiver track 70 may include any suitable number of track flanges 74. For example, in other embodiments, receiver track 70 may include more than four track flanges 74. In some embodiments, receiver track 70 includes fewer than four track flanges 74. In some embodiments, receiver track 70 includes at least two track flanges 74. Preferably, the number of track flanges 74 is equal to the number of lower tabs 76 and/or upper tabs 78.

In some embodiments, track flanges 74 are arranged in an evenly spaced row along first side 72*a*. In some embodiments, track flanges 74 extend from first side 72*a* of support 72 a distance L6. In some embodiments, length L6 is greater than length L5. In some embodiments, length L6 is greater than length L1 of mold supports 16. In other embodiments, length L6 is less than or equal to length L1. In some embodiments, track flanges 74 are positioned at or proximate the bottom of support 72 and extend opposite of lower tabs 76. In some embodiments, track flanges 74 are integrally formed with support 72. In other embodiments, track flanges 74 are formed separately from support 72 and secured thereto using any suitable means known in the art (e.g., adhesive, fasteners, joinery techniques, welding, etc.).

In some embodiments, each track flange 74 includes a top surface 74*a* and a bottom surface 74*b*. Top surface 74*a* and bottom surface 74*b* may be substantially parallel according to some embodiments. In some such embodiments, top surface 74*a* and bottom surface 74*b* are substantially perpendicular to first side 72*a* of support 72. In some embodiments, each top surface 74*a* of track flanges 74 is coplanar. In some embodiments, each bottom surface 74*b* of track flanges 74 is coplanar. In some embodiments, top surface 74*a* of track flanges 74 is coplanar with top surface 76*a* of lower tabs 76. In some embodiments, bottom surface 74*b* of track flanges 74 is coplanar with bottom surface 76*b* of lower tabs 76.

As shown in FIGS. 9*a* and 9*b*, top surface 74*a* and/or bottom surface 74*b* may be substantially trapezoidal in shape. In some embodiments, top surface 74*a* and/or bottom surface 74*b* of each track flange 74 is shaped as an isosceles trapezoid having a height equal to length L6 and its longer base positioned at first side 72*a* of support 72. In other embodiments, top surface 74*a* and/or bottom surface 74*b* may be configured as another polygonal shape (e.g., square, rectangle, triangle, etc.). According to these embodiments, each track flanges 74 includes one or more straight edges. In further embodiments, each track flange 74 may include one or more curved edges.

In some embodiments, adjacent track flanges 74 are separated by a gap 75. In some embodiments, each gap 75 has a length equal to the length of each track flange 74 (e.g., length L6). In other embodiments, gap 75 has a length shorter than the length of each track flange 74 (e.g., shorter than length L6). Gaps 75 in some embodiments are configured to provide a degree of clearance between adjacent track flanges 74 to allow for receiver track 70 to be curved. As described, this configuration may be advantageous according to certain embodiments, for example, when receiver track 70 is positioned along a curved section of the swimming pool (e.g., curved sections 3*a* and 3*b* of FIG. 1). As shown in FIGS. 9*a* and 9*b*, gaps 75 may be substantially aligned with gaps 77 in opposing pairs.

Gap 75 may be defined by angle ε formed between adjacent track flanges 74 according to some embodiments. In some embodiments, angle ε is equal to the angle between the neighboring side edges of adjacent track flanges 74. In some embodiments, angle ε is an acute angle from about 0° to about 45°, about 0° to about 40°, about 0° to about 35°, about 0° to about 30°, about 0° to about 28°, about 0° to about 25°, about 0° to about 20°, about 0° to about 15°, about 0° to about 10°, or about 0° to about 5°. In some embodiments, when receiver track 70 is in an unflexed or relaxed state, angle δ is from about 5° and about 25°, about 10° and about 20°, about 12° and about 18°, or about 14° and about 16°. In one embodiment, angle ε is about 14° when receiver track 70 is in an unflexed or relaxed state. In some embodiments, angle ε is substantially equal to angle δ when receiver track 70 is in an unflexed or relaxed state. In some embodiments, angle ε is substantially equal to angle α and/or angle β of molding platform 10 when molding platform 10 and receiver track 70 are both in an unflexed or relaxed state.

Similar to angle δ, angle ε may be increased or decreased relative to the angle in the unflexed or relaxed state depending on the desired curvature of receiver track 70 according to some embodiments. For example, when receiver track 70 is used with a convexly curved section of the swimming pool (e.g., curved section 3*a* of FIG. 1), receiver track 70 may be flexed such that the ends of track flanges 74 converge towards each other and angle ε is decreased. When receiver track is used with a concavely curved section of the swimming pool (e.g., curved section 3*b* of FIG. 1), receiver track 70 may be flexed such that the ends of track flanges 74 diverge away from each other and angle ε is increased. In some embodiments, when receiver track 70 is being flexed, angle ε increases as opposing angle δ decreases and vice versa.

In some embodiments, track flanges 74 are configured to be secured to the periphery of a swimming pool once receiver track 70 is arranged in its desired position. For example, track flanges 74 may be secured to wall portion 7 in FIG. 2 when receiver track 70 is used in place of track 6. In some embodiments, track flanges 74 may be secured into position by any suitable means known in the art, for example, using screws, nail, bolts, glue, cement, tape, etc. Preferably receiver track 70 is positioned such that space 80 opens towards the swimming pool interior. After receiver track 70 is secured into position, receiver track 70 may be engaged with the molding system as described above.

After the molding system is engaged with receiver track 70, the molding system may be used to mold the coping of the swimming pool in a manner similar to the procedures described above with respect to embodiments where the molding system is engaged with track 6. In certain embodiments, concrete or other material used to form the swimming pool coping can be poured over receiver track 70, which may be left in place along the periphery of the swimming pool. According to some of these embodiments, receiver track 70 forms a part of the finished swimming pool coping. In some embodiments, molding platform 10, backing 30, and molding block 40 are removed from the swimming pool coping before the concrete or other material completely hardens, for example, to allow the surface of the concrete or other material to be smoothed or textured.

In some embodiments, receiver tracks and molding systems of the present invention can be used to mold one section of the swimming pool coping at a time. In other embodiments, a receiver track and molding system may extend along the entire swimming pool coping. In some embodiments, a receiver track of the present invention is modular such that a plurality of receiver tracks are used with the molding system to mold the swimming pool coping. In some embodiments, for example, both receiver track 50 and receiver track 70 can be utilized together. In one such embodiment, receiver track 50 is utilized along straight sections of the swimming pool (e.g., straight section 3*c* of FIG. 1) and receiver track 70 is utilized along curved sections of the swimming pool (e.g., curved sections 3*a* and 3*b* of FIG. 1).

Further embodiments of the present invention relate to a tool particularly adapted for removing the molding systems of the present invention after the swimming pool coping has been formed. One such embodiment is illustrated in FIGS. 10*a*-10*d*, which shows tool 82 generally having a blade 84 and a handle 108 connected to blade 84. With reference to FIG. 2, blade 84 according to some embodiments is sized and configured to be inserted between panel 12 and pool liner 4 such that tool 82 can be used to pry molding platform 10 away from wall portion 7.

Figure 10A:
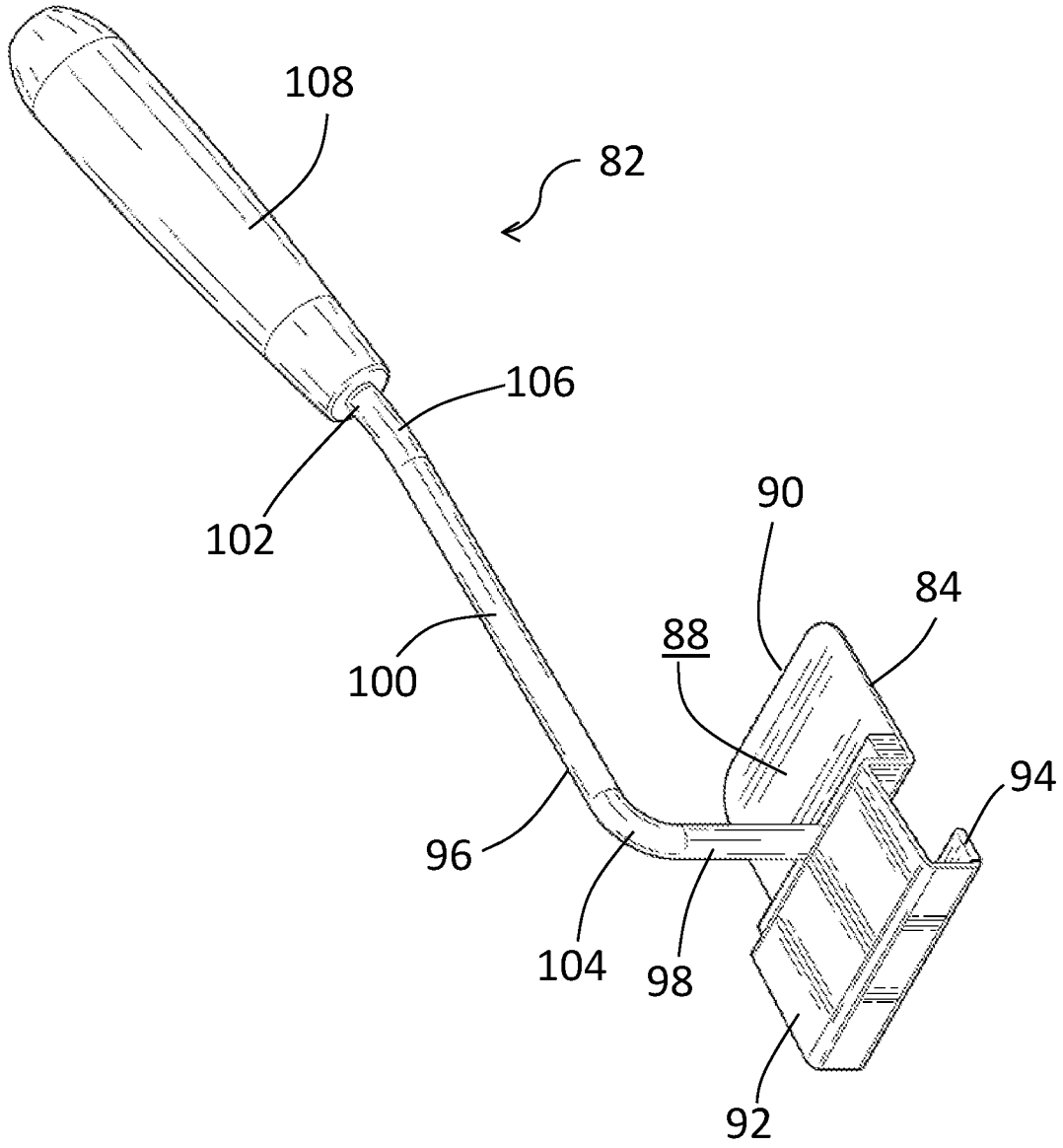
FIG. 10*a* is a perspective view of a tool for removing a molding system in accordance with an embodiment of the present invention.
Figure 10B:
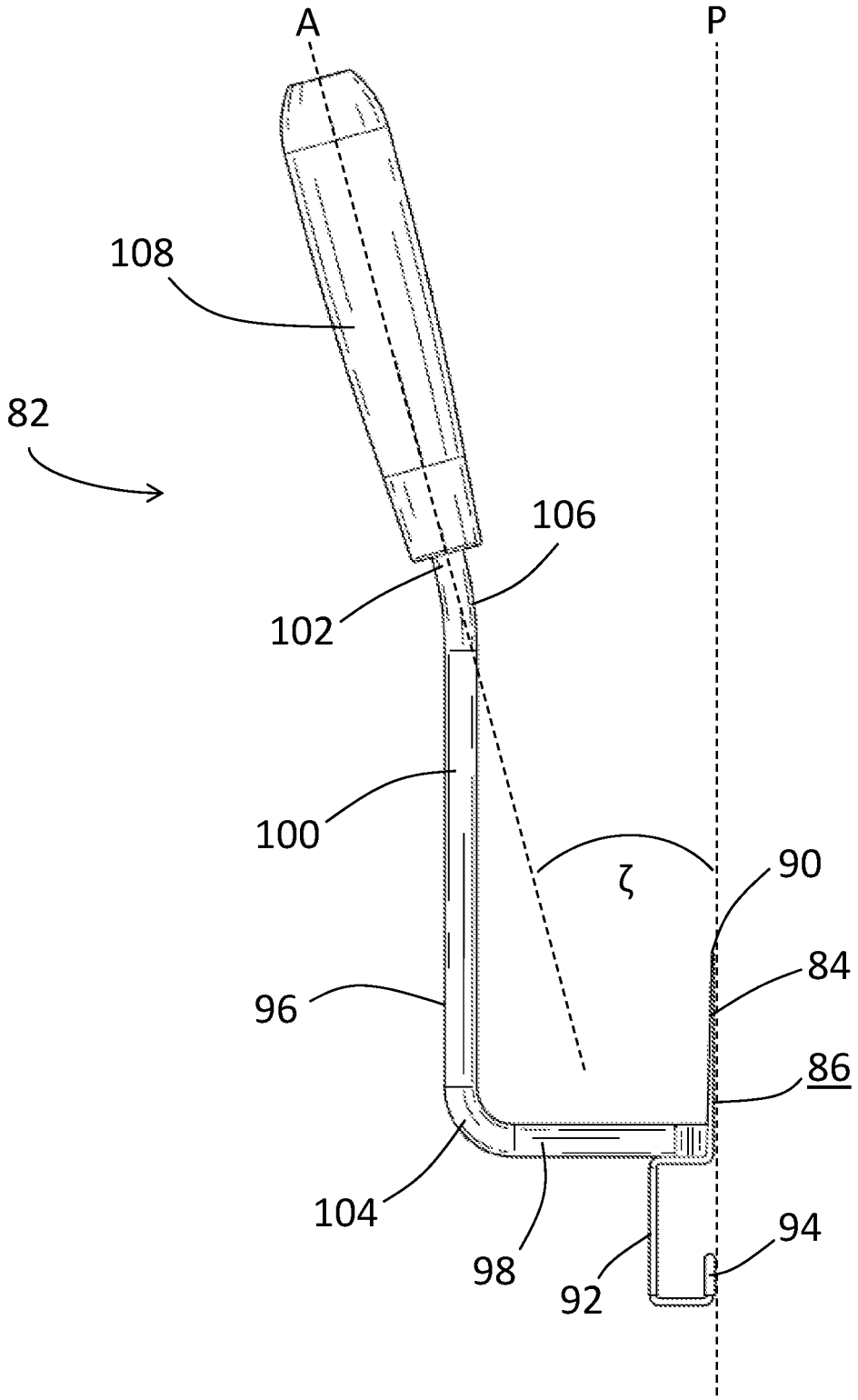
FIG. 10*b* is a side view of the tool of FIG. 10*a;*
Figure 10C:
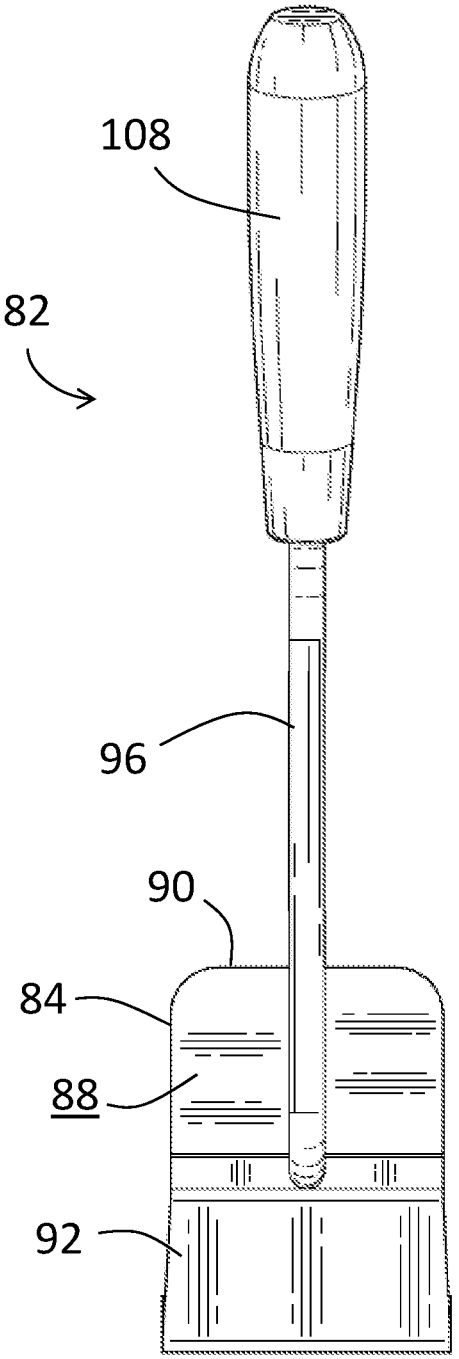
FIG. 10*c* is a front view of the tool of FIG. 10*a;*
Figure 10D:
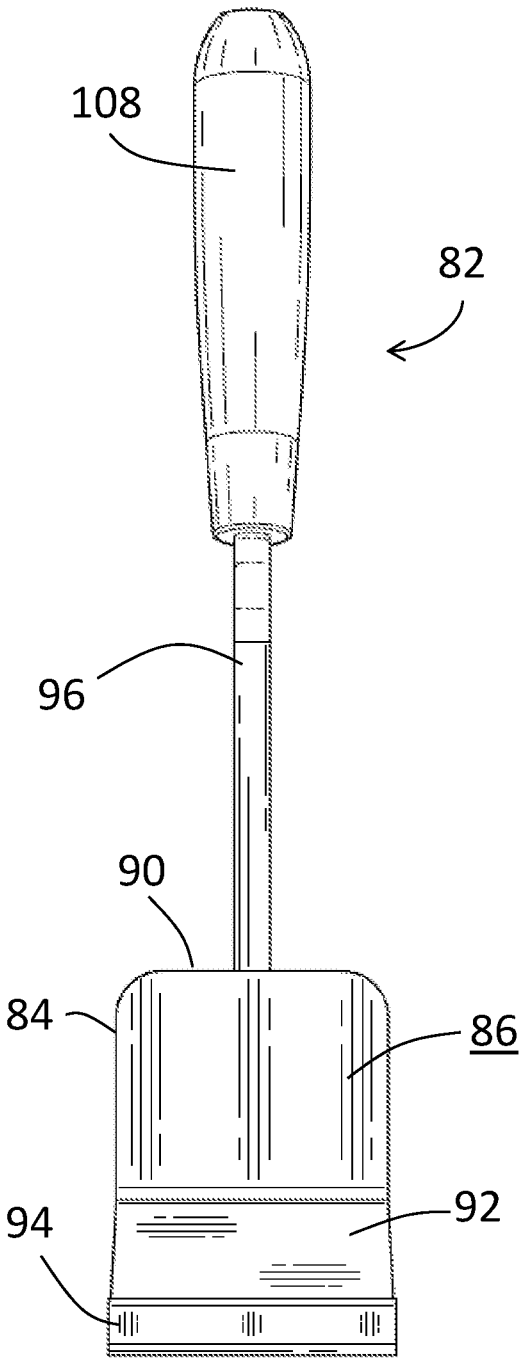
FIG. 10*d* is a back view of the tool of FIG. 10*a;*

Referring again to FIGS. 10*a*-10*d*, in some embodiments blade 84 includes a bottom surface 86 and a top surface 88 which terminate at edge 90. Bottom surface 86 and top surface 88 according to certain embodiments are planar or substantially planar. In some embodiments, bottom surface 86 and top surface 88 may be substantially parallel. In other embodiments, for example as shown in FIG. 10*b*, bottom surface 86 and top surface 88 taper towards edge 90. Opposite of edge 90, blade 84 is connected to a base 92 according to further embodiments. In some embodiments, blade 84 is integrally formed with base 92. Base 92 in some embodiments includes an abutment 94 which is configured to abut against pool liner 4 when blade 84 is inserted between panel 12 and pool liner 4. Abutment 94 may be positioned at an end of base 92 and may include a surface that is coplanar or substantially coplanar with bottom surface 86 of blade 84. In some embodiments, abutment 94 forms a pivot against pool liner 4 when tool 82 is used to pry molding platform 10 away from wall portion 7.

Blade 84 and base 92 are preferably made from a substantially rigid material. In some embodiments, blade 84 and/or base 92 may be made of metal or metal alloy (e.g., steel, aluminum, etc.). For example, in some embodiments, blade 84 and base 92 can be fabricated from a single sheet of metal that is bent to have the shape illustrated in FIGS. 10*a*-10*d*. In other embodiments, blade 84 and/or base 92 may be made of substantially rigid plastic. In certain embodiments, abutment 94 may further include a sleeve or coating configured to prevent damage or scratches to pool liner 4 when abutment 94 abuts against pool liner 4. For example, in some embodiments, abutment 94 may include a sleeve or coating made from plastic, foam, felt, silicone, or rubber.

In certain embodiments, tool 82 further includes a handle 108 configured to be grasped by a user's hand. As shown in FIG. 10*b*, handle 108 in some embodiments is disposed about an axis A that may be obliquely angled with respect to a plane P that is coplanar with bottom surface 86 and/or abutment 94. In some embodiments, axis A forms an acute angle $\zeta$ with respect to plane P which may be about 45° or less, about 40° or less, about 35° or less, about 30° or less, about 25° or less, about 20° or less, about 15° or less, about 10° or less, or about 5° or less. In yet other embodiments, axis A may be parallel to plane P.

Handle 108 may be connected to blade 84 by a shaft 96 which is substantially rigid. In some embodiments, shaft 96 is substantially linear and may be disposed along axis A. In other embodiments, shaft 96 may be curved. In yet other embodiments, shaft 96 may include two or more substantially linear portions that are connected by curves or bends in shaft 96. For example, as shown in FIGS. 10*a* and 10*b*, shaft 96 in some embodiments includes a first portion 98, a second portion 100, and a third portion 102, which may have unequal lengths. In some embodiments, shaft 96 further includes a first bend 104 between first portion 98 and second portion 100, and a second bend 106 between second portion 100 and third portion 102. Handle 108 may be disposed about or extend from third portion 102 of shaft 96. In the illustrated embodiment, first portion 98 of shaft 96 is attached to top surface 88 of blade 84 and/or attached to base 92. First portion 98 may be perpendicular or substantially perpendicular to bottom surface 86 of blade 84 and/or plane P. In some embodiments, first portion 98 has a length that is greater than L1. First bend 104, which connects first portion 98 with second portion 100, may have an angle such that second portion 100 generally extends in a direction away from base 92. In some embodiments, first bend 104 has an angle of 90° or about 90° such that second portion 100 generally extends parallel to bottom surface 86 of blade 84 and/or plane P. Second bend 102, which connects second portion 100 with third portion 102, may have an angle that is supplementary to angle $\zeta$ (i.e., 180° minus angle $\zeta$), such that third portion 102 extends along axis A.

The relative position of handle 108 and blade 84 of tool 82 may be particularly suited to allow a user who is situated on top of the swimming pool coping to remove molding platform 10 after top 3 has been formed and set. In use, according to certain embodiments, blade 84 may be inserted upwards and wedged between panel 12 and pool liner 4, preferably after molding block 40 and backing 30 have been separated and removed from molding platform 10. As blade 84 is inserted between panel 12 and pool liner 4, abutment 94 further abuts against pool liner 4. Pushing handle 108 away from the swimming pool coping (e.g., towards interior space 2) causes tool 82 to pivot where abutment 94 abuts pool liner 4 and causes blade 84 to pry panel 12 and molding platform 10 away from the pool liner 4. This force disengages molding platform 10 from track 6 and allows for molding platform 10 to be separated and removed from the swimming pool coping according to preferred embodiments. It should also be appreciated that tool 82 could be used in embodiments where the swimming pool does not have or use a pool liner. For example, tool 82 could be used to separate molding platform 10 from a receiver track (e.g., receiver track 50 or 70) that may be used when swimming pools do not include a track configured to receive a pool liner. According to these embodiments, blade 84 may inserted between panel 12 of molding platform 10 and the pool wall while abutment 94 abuts directly against the pool wall.

Figure 11:
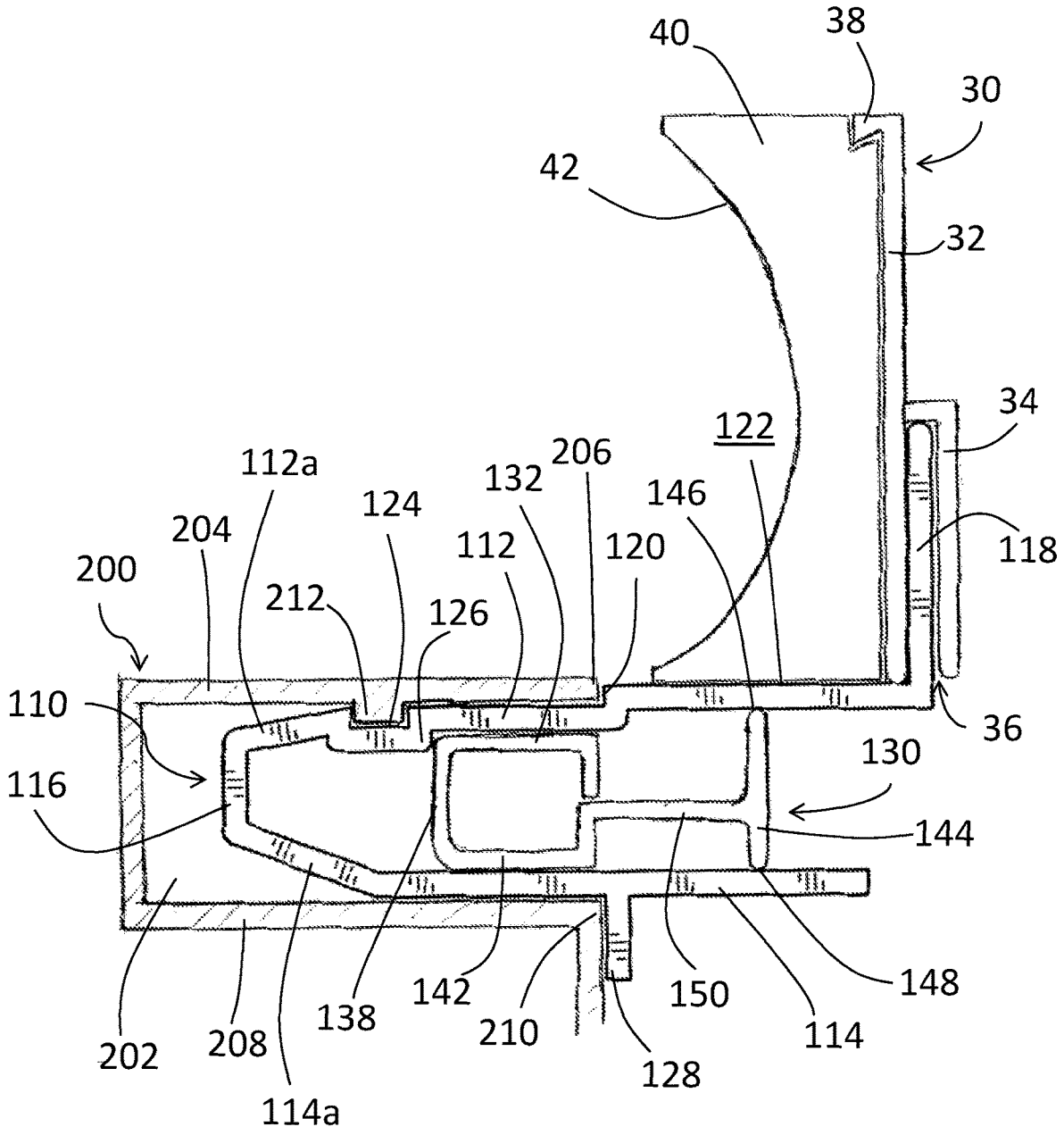
FIG. 11 is a side cross section view of a molding system engaged with a swimming pool cover track in accordance with an embodiment of the present invention.

According to certain other embodiments, some swimming pools may be provided with retractable pool covers. Some such retractable pool covers are configured to slide within cover tracks which are positioned along at least a portion of the swimming pool periphery. In some embodiments, it may be desirable to utilize these cover tracks for mounting a molding system for molding the coping above the cover tracks. FIG. 11 illustrates a further embodiment of a molding system according to the present invention which includes an adaptor 110 configured to be positioned at least partially within a cover track 200. Adaptor 110, in some embodiments, is further configured to support backing 30 and molding block 40 in a manner similar to molding platform 10. Cover track 200 may define an interior space 202 that is open to the swimming pool interior and configured to receive a retractable pool cover. As shown in FIG. 11, cover track 200 includes an upper wall 204 which terminates at upper end 206 and a lower wall 208 which terminates at lower end 210. In further embodiments, cover track 200 may include a ridge 212 which extends from upper wall 204 towards interior space 202. Some exemplary versions of cover track 200 are further depicted in FIGS. 15 and 16 wherein analogous components are labeled with "a" and "b" respectively.

Figure 12A:
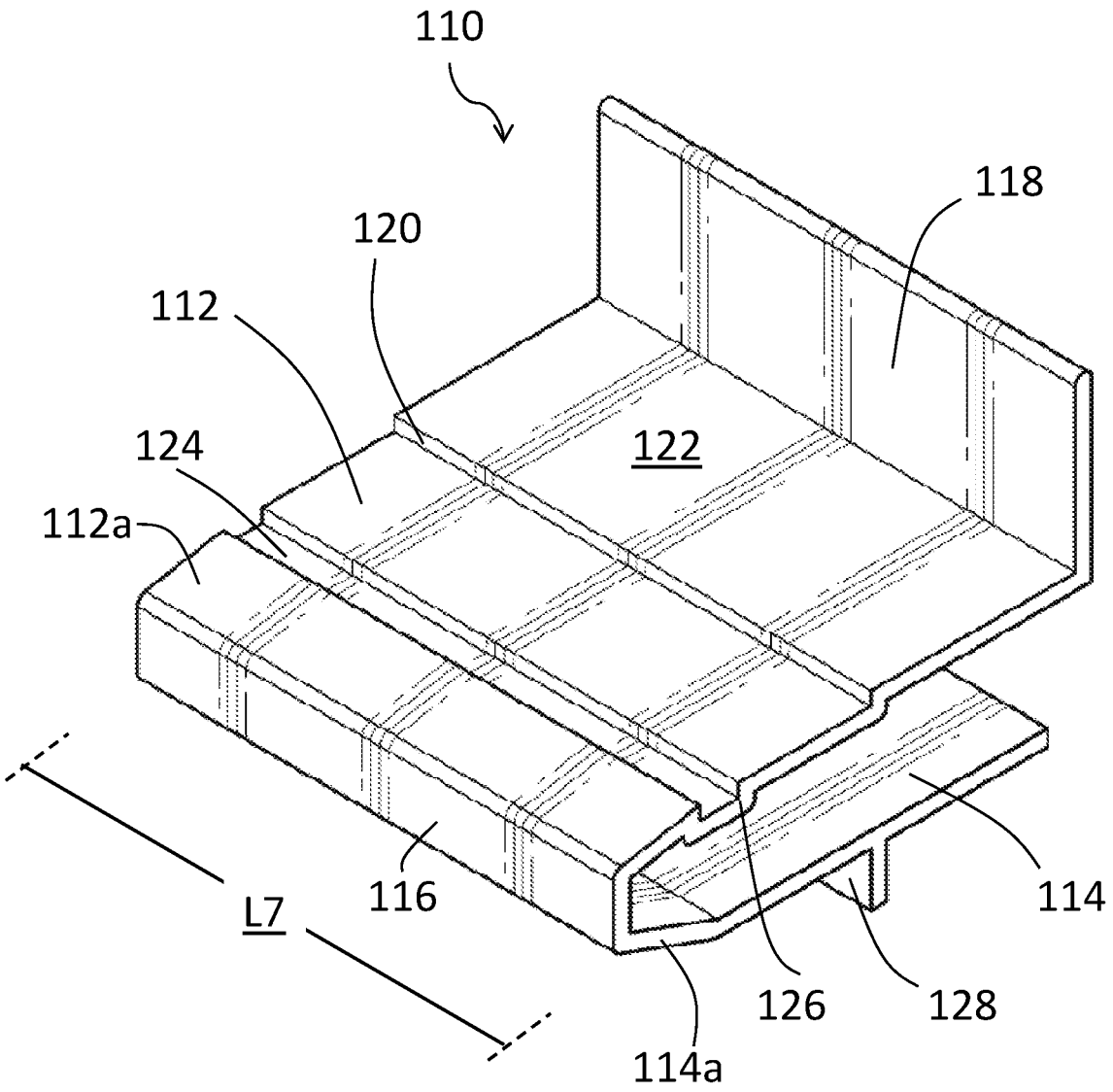
FIG. 12*a* is a perspective view of an adaptor for a molding system in accordance with an embodiment of the present invention configured to be received in a swimming pool cover track.
Figure 12B:
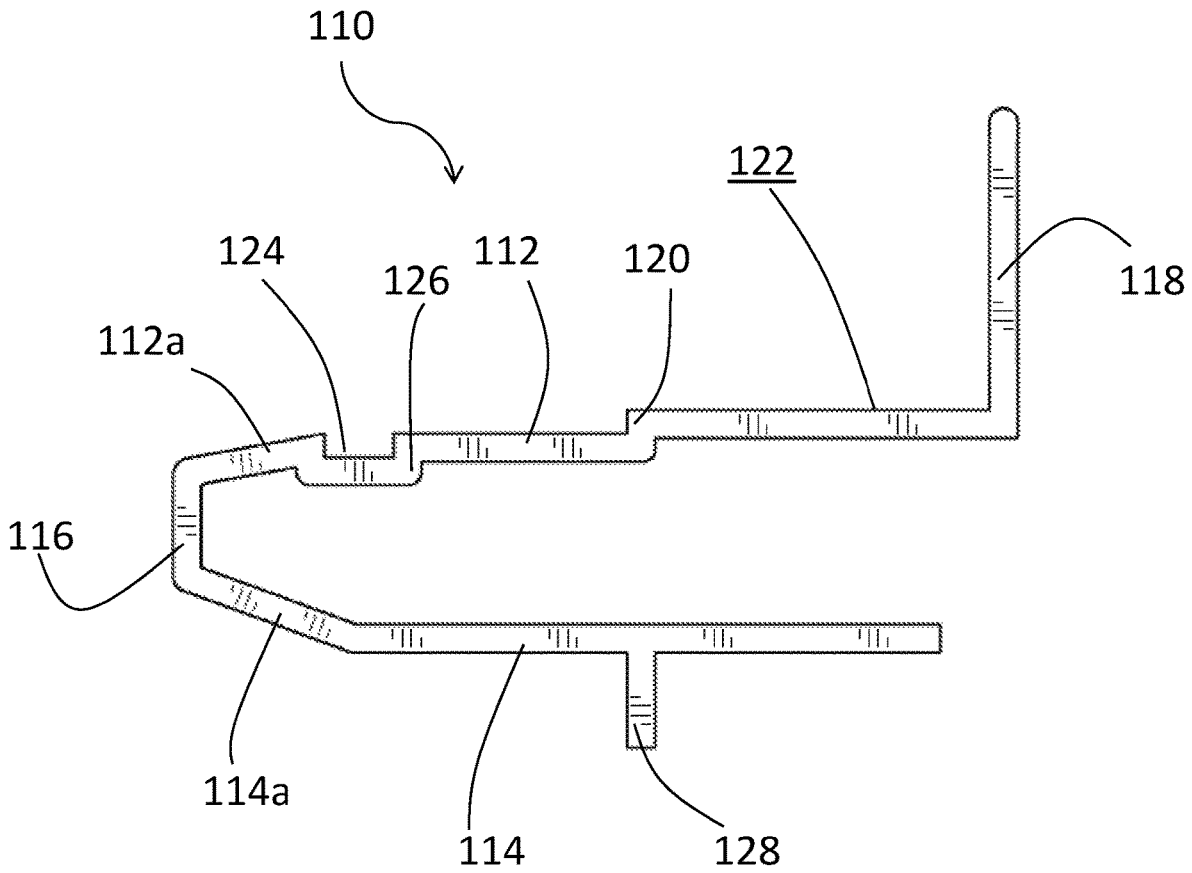
FIG. 12*b* is a side view of the adaptor of FIG. 12*a;*

With reference now to FIGS. 11-12*b*, adaptor 110 in certain embodiments is configured to form a tight fit within interior space 202. In some embodiments, adaptor 110 is configured to substantially prevent concrete or other molding materials from leaking into interior space 202 during use in the coping molding process. In some embodiments, adaptor 110 includes an upper portion 112 and a lower portion 114 which are spaced apart and joined by front wall 116. In some embodiments, upper portion 112 and lower portion 114 each extend back from front wall 116 to form a channel between upper portion 112 and lower portion 114. In some embodiments, lower portion 114 extends from a bottom of front wall 116 and upper portion 112 extends from a top of front wall 116. In some embodiments, at least a portion of upper portion 112 and lower portion 114 tapers toward front wall 116. In some embodiments, for example, a front portion 112*a* of upper portion 112 and front portion 114*a* of lower portion 114 taper towards front wall 116 and are angled obliquely relative to front wall 116. In some embodiments, the taper between front portion 112*a* and front portion 114*a* facilitates insertion of adaptor 110 into interior space 202. In some embodiments, upper portion 112 is at least partially parallel to lower portion 114. In some embodiments, at least a portion of upper portion 112 and at least a portion of lower portion 114 are perpendicular to front wall 116. In some embodiments, adaptor 110 is configured such that upper portion 112 and lower portion 114 can flex at least slightly toward each other in order facilitate insertion of adaptor 110 into interior space 202. In other embodiments, adaptor 110 is substantially rigid such that upper portion 112 and lower portion 114 of adaptor 110 do not substantially flex.

In some embodiments, at least a portion of upper portion 112 is configured to abut against upper wall 204, and at least a portion of lower portion 114 is configured to abut against lower wall 208 when adaptor 110 is received within interior space 202 during use. In some embodiments, adaptor 110 is configured to form a friction fit with cover track 200. In some embodiments, adaptor 110 is configured to form a snap fit with cover track 200. Adaptor 110 may be constructed from a sturdy yet flexible material according to some embodiments. In some embodiments, adaptor 110 is constructed from a substantially rigid material. In some embodiments, adaptor 110 is made from a plastic material. In other embodiments, adaptor 110 may be made from metal, metal alloys, wood, or composite materials. Moreover, it should be appreciated that adaptor 110 may have any suitable length L7 to match the length of cover track 200 of the swimming pool. In some embodiments, a plurality of adaptors 110 are positioned along the length of cover track 200, each adaptor 110 having the same or different length L7. In some embodiments, for example, length L7 may be up to 3 feet, up to 6 feet, up to 8 feet, up to 12 feet, up to 20 feet, or up to 24 feet.

As shown in the illustrated embodiments, upper portion 112 extends away from front wall 116 to an upper flange 118 which is sized and configured to be received by slot 36 defined by clip 34 of backing 30. In certain embodiments, upper portion 112 further includes an exterior step 120 positioned at a location between front wall 116 and upper flange 118. In some such embodiments, exterior step 120 is configured to abut against upper end 206 of cover track 200 when adaptor 110 is inserted into interior space 202. In further embodiments, upper portion 112 includes a support surface 122, which is configured to support molding block 40 which may be engaged with ledge 38 of backing 30, as shown in FIG. 11. Support surface 122 may be generally perpendicular to upper flange 118. In some embodiments, support surface 122 extends outside of interior space 202 to upper flange 118. In some embodiments, support surface 122 is located between exterior step 120 and upper flange 118. Upper portion 112 may further include a groove 124 which is sized and configured to receive ridge 212 of cover track 200 when adaptor 110 is inserted into interior space 202. Groove 124 may be positioned on an exterior surface of upper portion 112 between front wall 116 and exterior step 120. In some such embodiments, engagement of ridge 212 with groove 124 may help retain adaptor 110 in interior space 202. In certain embodiments, an interior step 126 which extends towards lower portion 114 may be formed on an interior surface of upper portion 112 opposite of groove 124.

In some embodiments, adaptor 110 includes a lower flange 128 which extends from lower portion 114. In some embodiments, lower flange 128 forms a right angle with lower portion 114. In some embodiments, lower flange 128 is configured to abut lower end 210 of cover track 200 when adaptor 110 is received within interior space 202. In some embodiments, lower flange 128 is generally aligned (e.g., vertically aligned) with exterior step 120 of upper portion 112, as shown for example in FIGS. 11 and 12*b*.

In further embodiments, at least one spacer 130 may be provided which is configured to be positioned between upper portion 112 and lower portion 114. In some embodiments, a plurality of spacers 130 is provided which may be distributed along the length L7 of adaptor 110 during use. Spacer 130 in certain embodiments is configured to maintain contact between adaptor 110 with upper wall 204 and lower wall 208 of cover track 200, for example, to maintain a tight fit between adaptor 110 and cover track 200. In some embodiments, spacer 130 is configured to push against interior surfaces of upper portion 112 and lower portion 114.

In some embodiments, spacer 130 is configured to form a friction fit with adaptor 110. In some embodiments, spacer 130 is configured to limit the amount that upper portion 112 and lower portion 114 can flex towards each other. In some embodiments, spacer 130 is configured to prevent upper portion 112 and lower portion 114 from flexing towards each other after spacer 130 is inserted between upper portion 112 and lower portion 114. Spacer 130 may be constructed from a sturdy yet flexible material according to some embodiments. In some embodiments, spacer 130 is constructed from a substantially rigid material. In some embodiments, spacer 130 is made from a plastic material. In other embodiments, spacer 130 may be made from metal, metal alloys, wood, or composite materials. Spacer 130 may be made, for example, by molding, machining, additive manufacturing (e.g., 3D printing), or other suitable techniques known in the art, and may be of a unitary or monolithic construction.

Figure 13A:
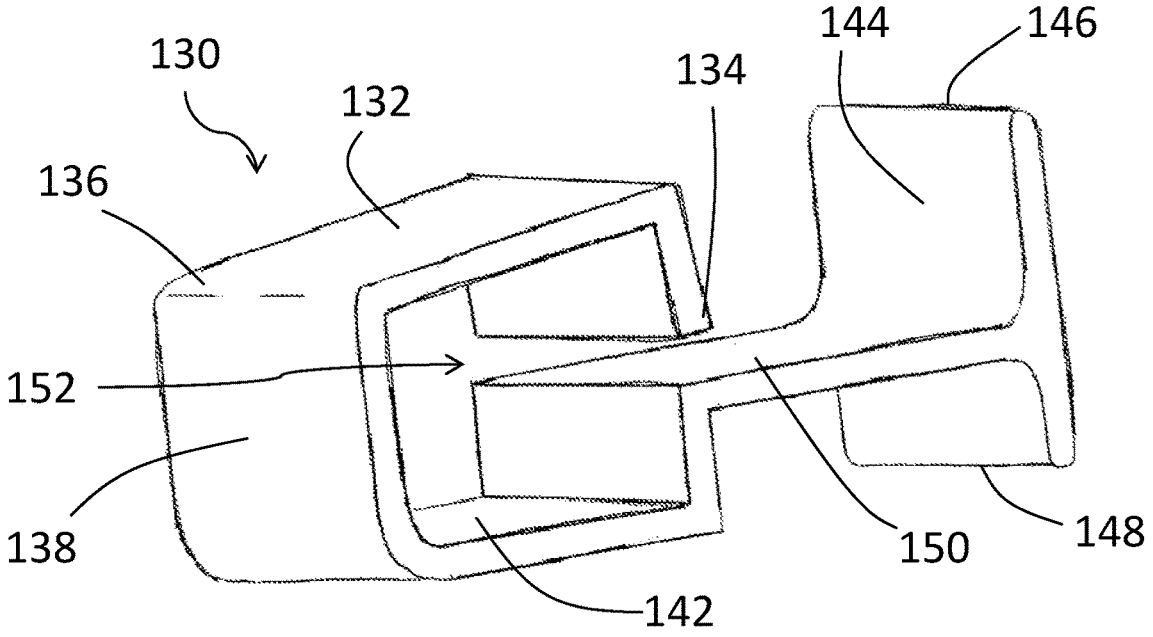
FIG. 13*a* is a perspective view of a spacer in accordance with an embodiment of the present invention.
Figure 13B:
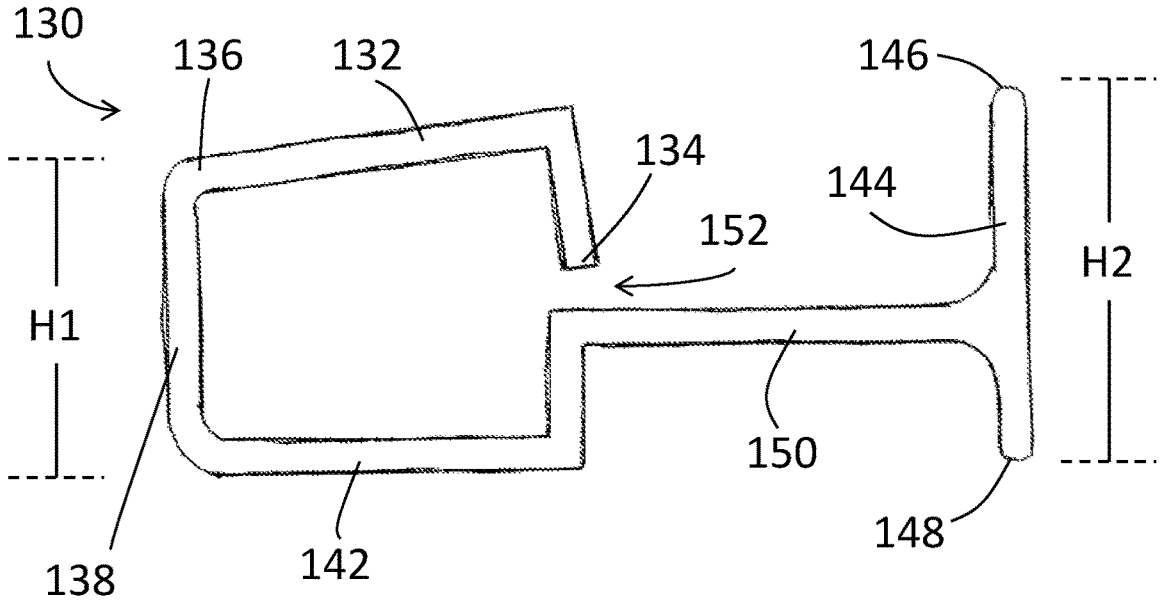
FIG. 13*b* is a side view of the spacer of FIG. 12*a;*

Referring to FIGS. 11, 13*a*, and 13*b*, spacer 130 according to some embodiments includes a biasing element, for example cantilever spring 132, which may be configured to push against upper portion 112 or lower portion 114 of adaptor 110 when spacer 130 is positioned between upper portion 112 and lower portion 114. In some embodiments, cantilever spring 132 includes a free end 134 and a fixed end 136 connected to a front support 138. In certain embodiments, cantilever spring 132 may have an L-shaped cross-section such that cantilever spring arm includes a bend 140 between free end 134 and fixed end 136. Bend 140 may be about 90° according to some embodiments. In some embodiments, fixed end 136 of cantilever spring 132 is connected to a top of front support 138.

In some embodiments, front support 138 of spacer 130 may further be connected to a base 142. In some embodiments, base 142 is substantially perpendicular to front support 138. In some embodiments, base 142 is connected to a bottom of front support 138 which is opposite to where front support 138 is connected to fixed end 136 of cantilever spring 132. As shown in the embodiment of FIG. 13*b*, front support 138 may extend vertically between cantilever spring 132 and base 142 with a height H1. In some embodiments, base 142 is configured to contact lower portion 114 of adaptor 110 while cantilever spring 132 contacts upper portion 112 of adaptor 110 when spacer 130 is positioned between upper portion 112 and lower portion 114. It should also be appreciated that in other embodiments, spacer 130 may be flipped such that cantilever spring 132 contacts lower portion 114 while base 142 contacts upper portion 112. In some embodiments, front support 138 is configured to abut against interior step 126 of adaptor 110 during use.

In further embodiments, spacer 130 includes a rear support 144. Rear support 144 in some embodiments extends between a top end 146 and a bottom end 148 with a height H2. In some embodiments, height H2 is greater than height H1 of front support 138. In some embodiments, rear support 144 may be parallel or substantially parallel with front support 138. In some embodiments, rear support 144 is configured to abut against upper portion 112 and lower portion 114 of adaptor 110 when spacer 130 is positioned between upper portion 112 and lower portion 114. For example, as shown in FIG. 11, in some embodiments, top end 146 may contact upper portion 112 and bottom end 148 may contact lower portion 114 of adaptor 110. In some embodiments, bottom end 148 may be coplanar or substantially coplanar with a surface of base 142. Moreover, in some embodiments, rear support 114 is configured to contact portions of upper portion 112 and lower portion 114 that extend outside of cover track 200. In some such embodiments, for example, rear support 144 is configured to be positioned below support surface 122 and/or molding block 40 during use.

Rear support 144 may be connected to base 142 by a connector 150. Connector 150 may include a portion which extends generally perpendicular from rear support 144. In some embodiments, connector 150 extends from rear support 144 at a location intermediate of top end 146 and bottom end 148. In some embodiments, connector 150 extends from rear support 144 at a location above or below a midpoint between top end 146 and bottom end 148. In some embodiments, spacer 130 includes a gap 152 between connector 150 and free end 134 of cantilever spring 132. In some embodiments, gap 152 provides clearance for cantilever spring 132 to pivot. In some embodiments, gap 152 provides clearance for cantilever spring 132 to pivot towards base 142. In some embodiments, gap 152 is a closeable gap. In some embodiments, free end 134 is configured to contact connector 150, such that gap 152 is closed, to limit movement of cantilever spring 132. For example, when spacer 130 is inserted between upper portion 112 and lower portion 114 during use, cantilever spring 132 may be pushed by adaptor 110 toward base 142 until free end 134 contacts connector 150 and gap 152 is eliminated.

With reference again to FIG. 11, the molding system shown in this illustrated embodiment may be used as follows. In some embodiments, adaptor 110 is inserted (front wall 116 first) into interior space 202 of cover track 200 until upper end 206 and lower end 210 of cover track 200 abuts against exterior step 120 and lower flange 128, respectively. In some embodiments, upper portion 112 and lower portion 114 of adaptor 110 may be flexed toward each other to facilitate insertion of adaptor 110 into interior space 202. In other embodiments, adaptor 110 is substantially rigid such that upper portion 112 and lower portion 114 of adaptor 110 do not substantially flex. In some embodiments, adaptor 110 may be initially inserted at an oblique angle such that front portion 114*a* of lower portion 114 is generally parallel to lower wall 208. In some embodiments, adaptor 110 is inserted at an oblique angle such that front portion 114*a* of lower portion 114 slides against lower wall 208. In some such embodiments, inserting adaptor 110 in this manner allows front portion 112*a* of upper portion 112 to pass below ridge 212. The angle of front portion 112*a* relative to front wall 116 may also help front portion 112*a* to pass below ridge 212 according to some embodiments. In some embodiments, once front portion 112*a* of upper portion 112 passes below ridge 212, ridge 212 may be allowed to engage with groove 124 on upper portion 112.

After adaptor 110 has been inserted into interior space 202, spacer 130 may be inserted between upper portion 112 and lower portion 114 of adaptor 110 until front support 138 abuts against interior step 126. As noted previously, spacer 130 is configured to maintain contact between adaptor 110 and cover track 200 to ensure a tight fit according to certain embodiments. After spacer 130 has been inserted and properly positioned, backing 30 may be coupled with adaptor 110 by inserting upper flange 118 into slot 36 defined by clip 34 extending from panel 32. In other embodiments, backing 30 is coupled to adaptor 110 prior to inserting adaptor 110 into cover track 200. Molding block 40 may then be positioned onto support surface 122 of adaptor 110 and engaged with ledge 38 of backing 30 such that molding surface 42 faces away from backing 30. In some embodiments, rear support 144 of spacer 130 helps support the weight of molding block 40 against upper portion 112. Concrete or other molding material may then be poured over cover track 200 and at least partially bounded by molding surface 42 of molding block 40 to form the swimming pool coping. Preferably, adaptor 110 prevents the concrete or other molding material from entering interior space 202 of cover track 200. Once the concrete or other molding material has set or hardened, molding block 40 and backing 30 may be removed from adaptor 110. Spacer 130 can then be removed from between upper portion 112 and lower portion 114 of adaptor 110. With spacer 130 removed, upper portion 112 and lower portion 114 of adaptor 110 may again be flexed toward each other, which may aid in the removal of adaptor 110 from cover track 200. In certain embodiments, a tool such as tool 82 may be used to facilitate removal of adaptor 110 from cover track 200. For example, blade 84 of tool 82 may be inserted between lower flange 128 of adaptor 110 and lower end 210 of cover track 200 and used to pry adaptor 110 from cover track 200.

FIGS. 14*a*-16 show another spacer 154 that may be used with adaptor 110 in accordance with further embodiments of the present invention. As with spacer 130, spacer 154 is configured to be inserted, at least partially, between upper portion 112 and lower portion 114 of adaptor 110 to limit the amount that upper portion 112 and lower portion 114 can flex towards each other. In some embodiments, spacer 154 may be used to maintain a tight fit between adaptor 110 and a cover track (e.g. cover track 200*a* or cover track 200*b*). In some embodiments, spacer 154 may be used in place of spacer 130. In other embodiments, spacer 154 may be used in addition to spacer 130 at different positions along the length L7 of adaptor 110. In some embodiments, a plurality of spacers 154 is provided which may be distributed along the length L7 of adaptor 110 during use. As with spacer 130, spacer 154 may be constructed from a sturdy yet flexible material according to some embodiments. In some embodiments, spacer 154 is constructed from a substantially rigid material. In some embodiments, spacer 154 is made from a plastic material. In other embodiments, spacer 154 may be made from metal, metal alloys, wood, or composite materials. Spacer 154 may be made, for example, by molding, machining, additive manufacturing (e.g., 3D printing), or other suitable techniques known in the art, and may be of a unitary or monolithic construction.

Figure 14A:
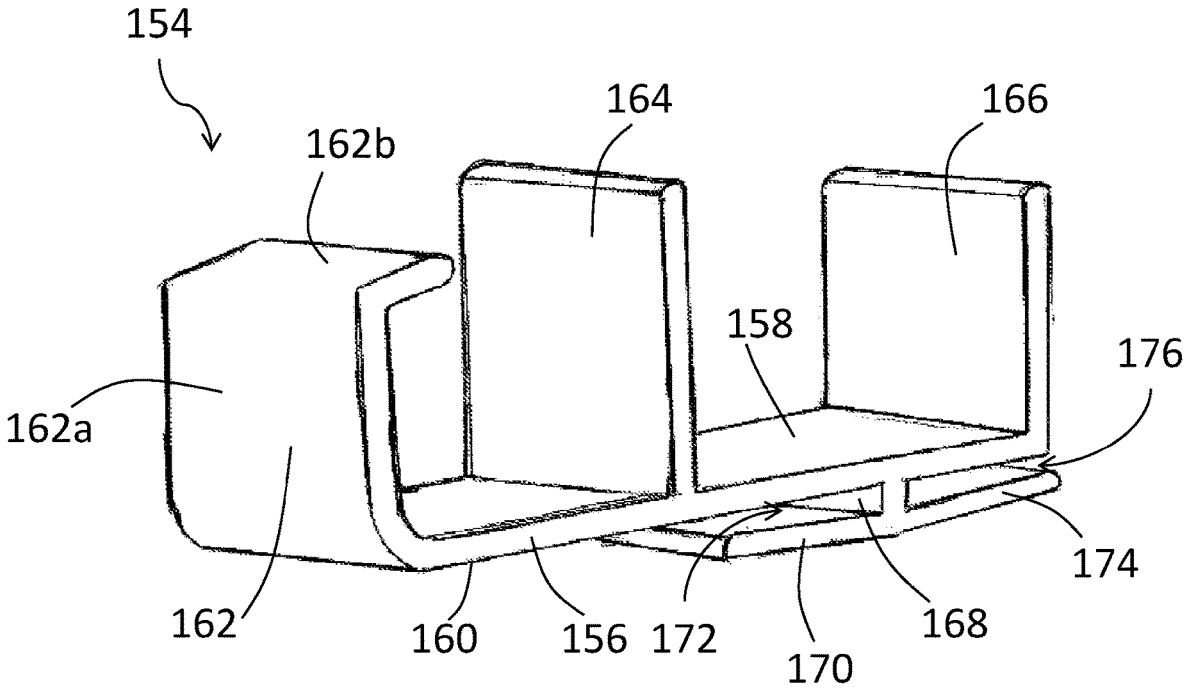
FIG. 14*a* is a perspective view of a spacer in accordance with a further embodiment of the present invention.
Figure 14B:
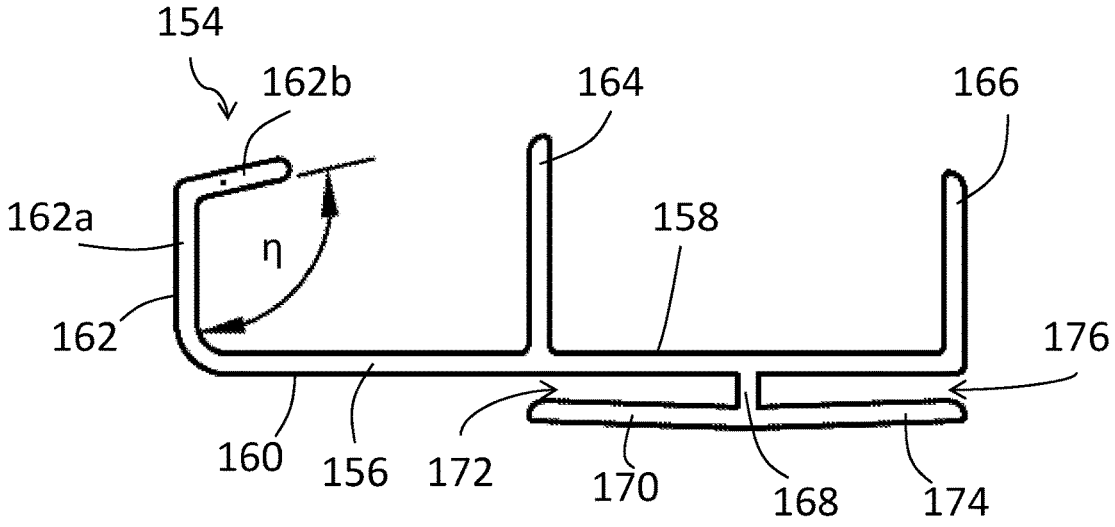
FIG. 14*b* is a side view of the spacer of FIG. 14*a;*

As shown in FIGS. 14*a* and 14*b*, spacer 154 includes a base 156. Base 156 may be planar or substantially planar and includes a top side 158 and a bottom side 160 opposite of top side 158. According to some embodiments, spacer 154 further includes at least one support, preferably at least two supports, which is connected to and extends from top side 158 of base 156. In the illustrated embodiments, spacer 154 includes three supports on top side 158, namely first support 162, second support 164, and third support 166. It may be possible to have more than three supports on top side 158 in other embodiments of the invention. First support 162 and third support 166 may be positioned at opposite ends of base 156 according to some embodiments, and second support 164 may extend from base 156 at a position between first support 162 and third support 166. In some embodiments, second support 164 may be positioned closer to first support 162 than to third support 166. In other embodiments, second support 164 may be positioned midway between first support 162 and third support 166. In certain embodiments, one or more of first, second, and third supports 162, 164, and 166 is or includes a generally rectangular panel that is perpendicular or substantially perpendicular to base 156. In some embodiments, one or more of first, second, and third supports 162, 164, and 166 further includes a rounded top edge, the top edge of a support being the edge of the support that is furthest away from base 156. In some embodiments, each of first, second, and third supports 162, 164, and 166 has a width that is equal to a width of base 156. In some embodiments, second support 164 and third support 166 are perpendicular or substantially perpendicular to base 156. In some embodiments, second support 164 and third support 166 are parallel or substantially parallel to each other. In certain embodiments, first support 162 includes a first portion 162*a* that is perpendicular or substantially perpendicular to base 156 and a second portion 162*b* that is angled relative to first portion 162*a* toward second support 164. In some embodiments, second portion 162*b* is obliquely angled relative to first portion 162*a*. In some embodiments, first portion 162*a* and second portion 162*b* form an obtuse angle $\eta$ which may range, for example, from about 91° to about 115°, about 95° to about 110°, or about 100° to about 105°. In some embodiments, the heights of first, second, and third supports 162, 164, and 166 may be different, wherein the height of a support refers to the straight distance between top side 158 and the end of the support that is furthest away from top side 158. In some embodiments, the height of third support 166 is less than the height of the first and/or second supports 162 and 164. In some embodiments, the height of first support 162 is less than the height of second support 164. Thus, in some embodiments, the height of second support 162 is greater than the height of first support 162 which in turn is greater than the height of third support 166.

In some embodiments, spacer 154 includes a bottom support 168 which extends from bottom side 160 of base 156. Bottom support 168, in some embodiments, may extend from base 156 at a location between where base 156 connects with second support 164 and third support 166. In some embodiments, bottom support 168 extends from base 156 at a location midway between where base 156 connects with second support 164 and third support 166. Bottom support 168 may be perpendicular or substantially perpendicular to bottom side 160 of base 156. In further embodiments, spacer 154 includes first lip 170 and second lip 174 that extend from opposite sides of bottom support 168. In some embodiments, first lip 170 and second lip 174 are symmetrically arranged about bottom support 168. In some embodiments, first lip 170 and second lip 174 are parallel or substantially parallel with bottom side 160. In other embodiments, as shown in FIGS. 14*a* and 14*b*, first lip 170 and second lip 174 are not parallel with bottom side 160. In some embodiments, first lip 170 and second lip 174 are acutely angled with respect to support 168. In some embodiments, first lip 170 and second lip 174 are angled such that first lip 170 and second lip 174 extend away from bottom support 168 toward bottom side 160. In further embodiments, first lip 170 extends a distance from bottom support 168 to about where base 156 connects with second support 164 and second lip 174 extends a distance from bottom support 168 to about where base 156 connects with third support 166. In some embodiments, a first slot 172 is defined between first lip 170 and bottom side 160 of base 156. A second slot 176 is defined between second lip 174 and bottom side 160 of base 156 in further embodiments. As will be further described herein, first slot 172 and second slot 176 are configured to receive lower portion 114 of adaptor 110 during use. In some embodiments, lower portion 114 forms a friction fit with first slot 172 or second slot 176 during use.

Figure 15:
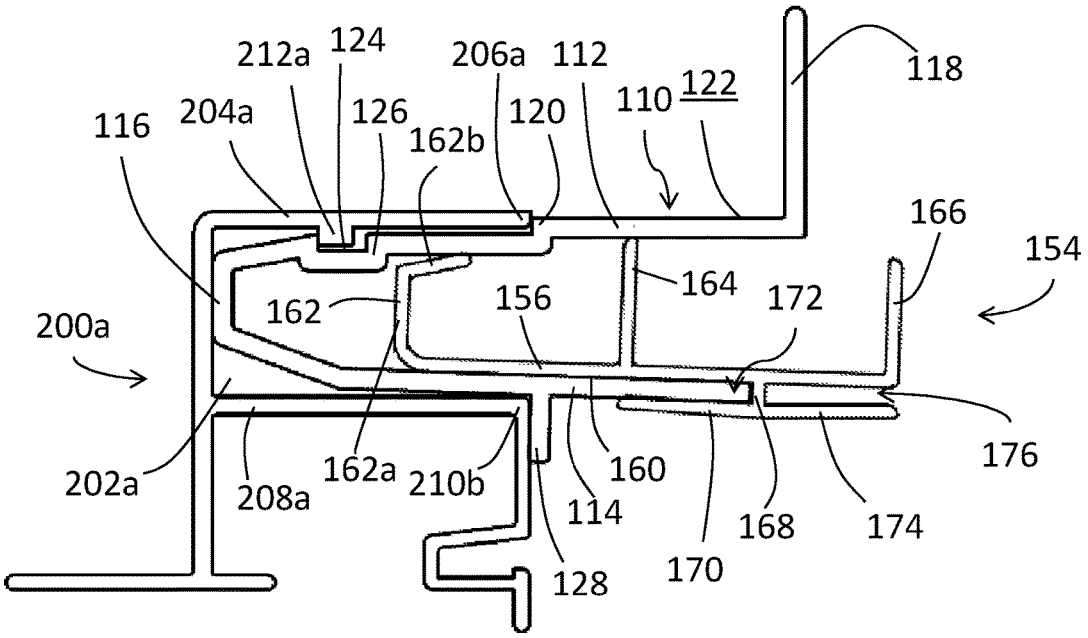
FIG. 15 is a side cross sectional view of an adaptor received in a swimming pool cover track and coupled with the spacer of FIGS. 14*a* and 14*b* in accordance with an embodiment of the present invention.
Figure 16:
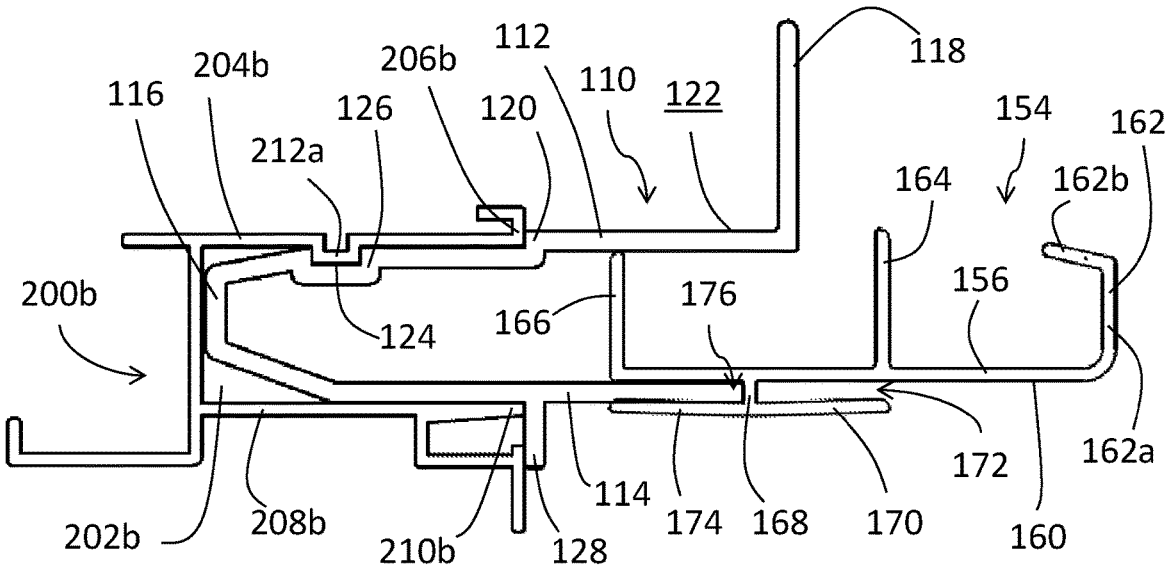
FIG. 16 is side cross sectional view of an adaptor received in a swimming pool cover track and coupled with the spacer of FIGS. 14*a* and 14*b* in accordance with another embodiment of the present invention.

FIGS. 15 and 16 show spacer 154 coupled with adaptor 110 which is inserted into exemplary cover tracks 200*a* and 200*b* in accordance with certain embodiments of the present invention. Each of cover tracks 200*a* and 200*b* includes components that are analogous to cover track 200 shown in FIG. 11, which are labeled with "a" and "b" respectively. For example, cover track 200*a*, 200*b* includes an upper wall 204*a*, 204*b* which terminate at upper end 206*a*, 206*b* and lower wall 208*a*, 208*b* which terminate at lower end 210*a*, 210*b*. In certain embodiments, cover tracks 200*a* and 200*b* further include ridge 212*a*, 212*b* which extends from upper wall 204*a*, 204*b* towards interior space 202*a*, 202*b*. In some embodiments, each of cover tracks 200*a* and 200*b* include additional flanges, grooves, or tracks which may be used, for example, to attach cover tracks 200*a* and 200*b* to the pool wall or other components as is known in the art. Adaptor 110 may be inserted into cover tracks 200*a* or 200*b* in a manner similar to the embodiments described with respect to FIG. 11. In some embodiments, adaptor 110 is inserted (front wall 116 first) into interior space 202*a*, 202*b* until upper end 206*a*, 206*b* and lower end 210*a*, 210*b* abut against exterior step 120*a* and lower flange 128*a* of adaptor 110, respectively, and ridge 212*a*, 212*b* engages with groove 124. In some embodiments, front wall 116 may also abut an inner surface of cover track 200*a*, 200*b* that defines interior space 202*a*, 202*b*. For simplicity, backing 30 and molding block 40 are not shown in FIGS. 15 and 16, however it should be understood that these components may be positioned on adaptor 110 in the manner described with respect to FIG. 11.

In the embodiment shown in FIG. 15, spacer 154 is inserted into adaptor 110 such that first support 162 and second support 164 are positioned between upper portion 112 and lower portion 114 and bottom side 160 of base 156 is positioned against lower portion 114. In some embodiments, spacer 154 is positioned such that second portion 162*b* of first support 162 is configured to contact upper portion 112 at a location between interior step 126 and exterior step 120, and second support 164 is configured to contact upper portion 112 at a location between exterior step 120 and upper flange 118. In this embodiment, second support 164 may help support the weight of a molding block (not shown) which can be positioned on support surface 122 of upper portion 112. In some embodiments, second portion 162*b* may flex slightly towards base 156 as spacer 154 is inserted into adaptor 110. In further embodiments, first support 162 may also contact interior step 126. As further shown in this embodiment, lower portion 114 is received in first slot 172 defined between first lip 170 and bottom side 160 of base 156 of spacer 154. In some embodiments, lower portion 114 forms a friction fit with spacer 154 at first slot 172. In some embodiments, first lip 170 is configured to flex slightly away from bottom side 160 when lower portion 114 is received in first slot 172. In some embodiments, the end of lower portion 114 abuts against bottom support 168 when lower portion 114 is fully received by first slot 172. Third support 166 may be positioned outside of adaptor 110 in this embodiment such that third support 166 is not in contact with adaptor 110. As with spacer 130, spacer 154 may be configured to maintain contact between adaptor 110 and cover track 200*a* to ensure a tight fit according to certain embodiments.

In certain embodiments, particularly where the cover track defines a more vertically narrow interior space, it may be desirable to alternatively insert spacer 154 into adaptor 110 such that third support 166 is positioned between upper portion 112 and lower portion 114 while first support 162 and second support 164 are positioned outside of adaptor. This configuration is shown, for example, in FIG. 16. According to this embodiment, third support 166 is configured to contact upper portion 112 of adaptor 110 at a location between exterior step 120 and upper flange 118 such that third support 166 may help support the weight of a molding block (not shown) which can be positioned on support surface 122 of upper portion 112. In this arrangement, lower portion 114 is received in second slot 176 defined between second lip 174 and bottom side 160 of base 156 of spacer 154. In some embodiments, lower portion 114 forms a friction fit with spacer 154 at second slot 176. In some embodiments, second lip 174 is configured to flex slightly away from bottom side 160 when lower portion 114 is received in second slot 176. In some embodiments, the end of lower portion 114 abuts against bottom support 168 when lower portion 114 is fully received by second slot 176.

According to some embodiments, adaptor 110 may be provided in a kit together with one or more spacers 130 and/or one or more spacers 154. In some embodiments, a kit may further include backing 30 and/or molding block 40. Other kits may also include molding platform 10 and/or receiver track 50, 70. In certain embodiments, a kit according the present invention may include tool 82. In yet further embodiments, a kit may also include material that can be molded by the molding systems of the present invention (e.g., concrete mix).

While the embodiments described herein are illustrative of molding systems particularly useful for molding swimming pool copings, the molding systems described herein are not necessarily limited to this use. Some embodiments of the present invention may also be used for molding copings in connection with other pools (e.g., reflecting pools), ponds, baths, tubs, fountains, or the like. Indeed, molding systems according to certain embodiments of the present invention may be useful for molding other structures, for example, walls, countertops, overhangs, eaves, curbs, or the like. Other applications involving the molding of concrete or other materials may also benefit from embodiments of the present invention for at least the reasons set forth herein.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. Unless specifically set forth herein, the terms "a", "an" and "the" are not limited to one element but instead should be read as meaning "at least one".

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the method does not rely on the particular order of steps set forth herein, the particular order of the steps should not be construed as limitation on the claims. The claims directed to the method of the present invention should not be limited to the performance of their steps in the order written, and one skilled in the art can readily appreciate that the steps may be varied and still remain within the spirit and scope of the present invention.

What is claimed is:

1. A molding system for a swimming pool coping having a track for receiving a pool cover, the molding system comprising:

an adaptor sized and configured to be positioned at least partially within the track, the adaptor comprising:

a front wall configured to be inserted into the track;

a lower portion extending from a bottom of the front wall;

an upper portion extending from a top of the front wall and spaced apart from the lower portion, the upper portion and the lower portion defining a channel there between; and an upper flange extending from the upper portion; and a spacer sized and configured to be received in the channel defined between the lower portion and the upper portion of the adaptor, the spacer configured to abut against the lower portion and the upper portion when the spacer is received in the channel, wherein the spacer includes a base and at least one support extending from the base, and wherein a portion of the spacer is configured to extend outside of the channel when the spacer is received in the channel.

2. The molding system of claim 1 further comprising:

a back panel having a front surface and a back surface, the back panel configured to engage with the adaptor and having at least one clip defining a slot for receiving the upper flange of the adaptor when the back panel is engaged with the adaptor.

3. The molding system of claim 1, further comprising:

a molding block positionable on the upper portion of the adaptor, the molding block having a mold surface configured to mold a predetermined contour into a material.

4. The molding system of claim 1, wherein the track includes a ridge, and wherein the upper portion includes a groove configured to receive the ridge.

5. The molding system of claim 1, wherein a front portion of the lower portion and a front portion of the upper portion taper towards the front wall.

6. The molding system of claim 1, wherein the adaptor further includes a lower flange extending from the lower portion.

7. The molding system of claim 1, wherein at least a portion of the lower portion and the upper portion tapers toward the front wall.

8. The molding system of claim 1, wherein the spacer includes a plurality of supports extending from the base.

9. The molding system of claim 1, wherein the at least one support includes a first portion that is substantially perpendicular to the base and a second portion that is obliquely angled with respect to the first portion.

10. The molding system of claim 1, wherein the spacer includes a bottom support extending from a bottom side of the base, and a first lip extending from one side of the bottom support.

11. The molding system of claim 10, wherein the first lip forms an acute angle with the bottom support.

12. The molding system of claim 10, wherein the first lip defines a first slot with the bottom side of the base, and wherein the lower portion of the adaptor is configured to be received within the first slot.

13. The molding system of claim 10, wherein the spacer includes a second lip extending from a second side of the bottom support, wherein the first lip defines a first slot with the bottom side of the base, wherein the second lip defines a second slot with the bottom side of the base, and wherein the lower portion of the adaptor is configured to be received within the first slot or the second slot.

14. The molding system of claim 8, wherein at least one of the plurality of supports is positioned within the channel when the spacer is received in the channel.

15. The molding system of claim 8, wherein at least one of the plurality of supports is positioned outside of the channel when the spacer is received in the channel.

16. The molding system of claim 8, wherein the plurality of supports includes supports having different heights.

17. The molding system of claim 1, wherein the spacer includes a slot configured to receive the lower portion of the adaptor.

18. A molding system for a swimming pool coping having a track for receiving a pool cover, the molding system comprising:

an adaptor sized and configured to be positioned at least partially within the track, the adaptor comprising:

a front wall configured to be inserted into the track;

a lower portion extending from a bottom of the front wall;

an upper portion extending from a top of the front wall and spaced apart from the lower portion, the upper portion and the lower portion defining a channel there between; and an upper flange extending from the upper portion; and a plurality of spacers, each spacer of the plurality of spacers being sized and configured to be received in the channel defined between the lower portion and the upper portion of the adaptor at different locations along a length of the adaptor, each spacer of the plurality of spacers being configured to abut against the lower portion and the upper portion when the spacer is received in the channel.

19. The molding system of claim 18, further comprising:

a back panel having a front surface and a back surface, the back panel configured to engage with the adaptor and having at least one clip defining a slot for receiving the upper flange of the adaptor when the back panel is engaged with the adaptor.

20. The molding system of claim 18, further comprising:

a molding block positionable on the upper portion of the adaptor, the molding block having a mold surface configured to mold a predetermined contour into a material.

21. The molding system of claim 18, wherein each spacer of the plurality of spacers includes a base and at least one support extending from the base.

22. The molding system of claim 21, wherein a portion of the base is configured to extend outside of the channel when the spacer is received in the channel.

23. The molding system of claim 21, wherein each spacer of the plurality of spacers includes a plurality of supports extending from the base.

24. The molding system of claim 23, wherein at least one of the plurality of supports is positioned within the channel when the spacer is received in the channel.

25. The molding system of claim 23, wherein at least one of the plurality of supports is positioned outside of the channel when the spacer is received in the channel.

26. The molding system of claim 23, wherein the plurality of supports includes supports having different heights.

27. The molding system of claim 18, wherein each spacer of the plurality of spacers includes a slot configured to receive the lower portion of the adaptor.

* * * * *